US009065227B2

(12) United States Patent
Ashibu et al.

(10) Patent No.: US 9,065,227 B2
(45) Date of Patent: Jun. 23, 2015

(54) ELECTRICAL CONNECTOR

(71) Applicant: JAPAN AVIATION ELECTRONICS INDUSTRY, LIMITED, Tokyo (JP)

(72) Inventors: Kenta Ashibu, Tokyo (JP); Hiroyuki Yokoo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/219,244

(22) Filed: Mar. 19, 2014

(65) Prior Publication Data

US 2014/0342592 A1 Nov. 20, 2014

(30) Foreign Application Priority Data

May 17, 2013 (JP) ..... 2013-105194

(51) Int. Cl.

| | |
|---|---|
| ***H01R 11/22*** | (2006.01) |
| ***H01R 12/79*** | (2011.01) |
| ***H01R 12/88*** | (2011.01) |
| ***H01R 13/6594*** | (2011.01) |

(52) U.S. Cl.

CPC ..... *H01R 12/79* (2013.01); *H01R 12/88* (2013.01); *H01R 13/6594* (2013.01)

(58) Field of Classification Search

USPC ..... 439/267

See application file for complete search history.

(56) References Cited

U.S. PATENT DOCUMENTS

| | | | | |
|---|---|---|---|---|
| 7,736,164 | B2 * | 6/2010 | Okamura | 439/260 |
| 8,083,542 | B2 | 12/2011 | Kodaira | |
| 8,550,849 | B2 * | 10/2013 | Yamaji | 439/607.41 |
| 8,939,790 | B2 * | 1/2015 | Jung | 439/495 |
| 2008/0146075 | A1 * | 6/2008 | Mundt | 439/492 |
| 2011/0104938 | A1 * | 5/2011 | Suzuki | 439/493 |
| 2011/0130030 | A1 * | 6/2011 | Morita | 439/499 |
| 2011/0151682 | A1 | 6/2011 | Kodaira | |

FOREIGN PATENT DOCUMENTS

| | | |
|---|---|---|
| JP | 4837711 B2 | 12/2011 |

* cited by examiner

*Primary Examiner* — Jean F Duverne

(74) *Attorney, Agent, or Firm* — Collard & Roe, P.C.

(57) ABSTRACT

When an actuator is tilted to the rear so that a signal contact and a contact portion of a plate-like connection object are brought into contact with each other, a terminal portion, connected to a connecting portion of a board, of the signal contact is covered with a conductor member held in the actuator.

10 Claims, 26 Drawing Sheets

ELECTRICAL CONNECTOR

This application is based upon and claims the benefit of priority from Japanese patent application No. 2013-105194, filed on May 17, 2013, the disclosure of which is incorporated herein in its entirely by reference.

BACKGROUND OF THE INVENTION

1. Field of the Invention

This invention relates to an electrical connector for connection to a flat cable formed by film-coating conductive lines in the form of plate-like conductors, such as an FPC (Flexible Printed Circuit) or an FFC (Flexible Flat Cable), and in particular relates to an electrical connector, particularly a so-called back-flip electrical connector, adapted to be surface-mounted on a printed board.

2. Description of Related Art

A mobile electronic device such as a mobile telephone, a smartphone, or a tablet is always required to be reduced in size and thickness for reasons such as improving the operatability thereof and, therefore, an electrical connector (hereinafter may also be referred to simply as a "connector") to be incorporated in such a device is also inevitably required to be reduced in size and thickness.

As a connector of the type that is advantageous in reducing the thickness of a device, there is a so-called back-flip connector. This type of connector has a lever called an actuator at a position behind an opening which is provided for insertion of a cable therethrough. Hereinafter, in this specification, the side where the opening for insertion of the cable is provided will be referred to as the front of the electrical connector while its opposite side will be referred to as the rear of the electrical connector.

Usually, in the back-flip connector, when establishing electrical connection to the cable inserted through the opening, the actuator is tilted to the rear to press contacts in the connector against conductors of the cable, while, when detaching the attached cable, the actuator is raised to separate the contacts from the conductors. Since the actuator is in the tilted state while the cable is attached, it is possible to reduce the height of the connector attached with the cable.

On the other hand, a processor installed in an electronic device such as a smartphone has been increasing in speed year by year. Consequently, higher-speed signal transmission is carried out in wiring and an electrical connector in the electronic device. With the increase in transmission speed, a measure is required for a noise electromagnetic wave at a relatively low level which has not been a problem in the past.

For example, when a connector is surface-mounted on a printed board, terminals of the connector and signal wiring patterns on the printed board should be brought into contact with each other and electromagnetic waves may be generated at these contact portions. In order to prevent these electromagnetic waves from leaking to the outside of the connector, it may be considered to cover the entire connector with a conductor layer connected to ground, i.e. a shield.

Herein, if an attempt is made to cover the entire back-flip connector with a shield, the connector can be relatively easily covered with the shield on its front and lateral sides. However, the shield cannot be easily provided on the rear side of the connector due to various problems.

It may be considered to dispose a shield shell that covers the rear side of an actuator tilted to the rear. If such a shield shell is provided, it is possible to shield electromagnetic waves directed to the rear of the connector from contact points between the connector and the printed board. However, there is a possibility that providing such a shield shell may cause an increase in the size of the connector.

If the contact points as noise sources are present right under the actuator, it is necessary to consider to shield electromagnetic waves that advance directly upward from the contact points. In this event, it may be considered to provide a high shield that covers even the actuator in an upright state. However, in this case, an increase in the height of the entire connector is induced.

Alternatively, it may be considered not to provide, before a cable is attached, a shield for electromagnetic waves that advance directly upward from the contact points, and to carry out an operation of disposing a shield to cover the upper side of the actuator after the actuator is tilted to the rear to cause the cable to be attached. In this case, while it is possible to avoid an increase in the height of the connector, the connector mounting operation may become difficult.

Japanese Patent (JP-B) No. 4837711 (hereinafter referred to as "Patent Document 1") describes a surface-mount connector which relates to this invention. The connector described in Patent Document 1 is basically a so-called front-flip connector. Patent Document 1 describes an electrical connector that forms a shielding path through a path including a shield layer of a flat cable, thereby allowing a shield plate, provided to an actuator, to exhibit a shielding effect. As shown in FIG. 32, in Patent Document 1, electromagnetic waves that advance toward the rear of the electrical connector are dealt with by providing a shield shell 102 "which is formed by punching a plate made of a conductive material and partially covers an upper surface, both side surfaces, and a rear surface on the rear end side of a housing 11 (housing 101 in FIG. 32)" (paragraph [0021]).

This invention has been made under these circumstances and it is an object of this invention to provide a back-flip electrical connector which is small and thin while having a shield for shielding an electromagnetic wave at a rear portion of the electrical connector and which does not require adding a separate shield shell for covering the rear side of the electrical connector after the electrical connector is mounted on a board.

SUMMARY

In order to solve the problems mentioned above, as an aspect of the present invention, an electrical connector for connection between a plate-like connection object and a board is provided. Now it is assumed that a side where an opening for insertion of the connection object therethrough is provided is called a front and a side opposite to the opening is called a rear. Under the assumption the electrical connector comprises: a signal contact having a contact point for contact with a contact portion of the connection object and a terminal portion for connection to a connecting portion of the board; a housing holding the signal contact; a shield shell at least partially covering the housing; an insertion portion which is a space at least partially surrounded by a plane defined by the opening, the housing, and the shield shell; and an actuator having a structure in which an insulator at least partially covers a conductor member, the actuator adapted to operate to press the contact point of the signal contact against the contact portion of the connection object inserted into the insertion portion through the opening when the actuator is tilted to the rear. In addition, when the actuator is tilted to the rear so that the contact point of the signal contact and the contact portion of the connection object are brought into contact with each other, the conductor member covers a position, at the rear of the housing, where the connecting portion of the board and the terminal portion of the signal contact are connected to each other.

The electrical connector may be surface-mounted on the board. In this case, it is preferable that when the actuator is tilted to the rear, the position where the connecting portion of the board and the terminal portion of the signal contact are connected to each other is located under the actuator.

The conductor member may have an actuator terminal protruding from the insulator. In this case, it is preferable that the shield shell has an actuator-terminal contact portion which is in non-contact with the actuator terminal when the actuator is in an upright state, and which is in contact with the actuator terminal in a state where the actuator is tilted to the rear. With this structure, the conductor member establishes a path for electrical connection to the shield shell through the actuator terminal and the actuator-terminal contact portion.

The conductor member may be a beam-like member having a generally L-shape in cross section and extending in a width direction of the actuator.

The conductor member may be a beam-like member having a generally circular-arc cross section and extending in a width direction of the actuator.

A cross section of the actuator may have a convex portion protruding to the rear when the actuator is in an upright state, and at least part of the convex portion may cover the conductor member. With this structure, when the actuator is tilted to the rear, the convex portion extends downward, i.e. toward the board on which the electrical connector is mounted. Consequently, since the conductor member covered with the convex portion also approaches the board, it is possible to enhance the shielding effect.

The shield shell at least partially may cover a plane approximately parallel to a surface of the connection object inserted and a plane approximately perpendicular to the plane. As the ground terminal, a holddown may be used.

The shield shell may have a ground terminal for connection to a ground connecting portion of the board.

The connection object may have a structure in which a signal layer comprising the contact portion and a first insulating layer made of an insulator are stacked on one of surfaces of a base layer and a shield layer made of a conductor and a second insulating layer made of an insulator are stacked on the other surface of the base layer, wherein part of the shield layer is exposed from the second insulating layer, wherein a ground spring which generates a force in a direction to press a surface on the shield layer side of the connection object, inserted, for contact with the exposed part of the shield layer is provided in the insertion portion, and wherein when the connection object is inserted and the actuator is tilted to the rear, an electrically conductive path is formed through the shield layer, the ground spring, and the ground terminal.

Assuming that one of surfaces of the connection object is called a first surface and the other surface of the connection object is called a second surface, the electrical connector may comprise a first ground spring which is the ground spring that generates a force in a direction to press the first surface of the connection object inserted, and a second ground spring which is the ground spring that generates a force in a direction to press the second surface of the connection object inserted. In this case, it is preferable that: when the connection object is inserted with the first surface being on the shield layer side and with the second surface being on the signal layer side, an electrically conductive path is formed through the shield layer, the first ground spring, and the ground terminal; and when the connection object is inserted with the first surface being on the signal layer side and with the second surface being on the shield layer side, an electrically conductive path is formed through the shield layer, the second ground spring, and the ground terminal.

According to this invention, when the actuator is tilted to the rear, the conductor member incorporated in the actuator serves as a shield. Therefore, it is not necessary to provide a separate shield to surround the tilted actuator for the purpose of shielding electromagnetic waves advancing toward the outside from the inside of the electrical connector or electromagnetic waves advancing toward the inside of the electrical connector from the outside. Consequently, it is possible to obtain the shielding effect at the rear portion of the back-flip electrical connector without increasing the size and height of the electrical connector.

Further, according to this invention, since the actuator has the structure in which the insulator covers the conductor member, the actuator can have higher strength compared to a general actuator formed of only an insulator.

DETAILED DESCRIPTION OF THE PREFERRED EMBODIMENTS

An electrical connector 1 according to an embodiment of this invention will be described with reference to FIGS. 1 to 9. The electrical connector 1 is a connector for establishing electrical connection between a printed board (not illustrated) and a flat cable 30 as a plate-like connection object and is adapted to be mounted on the printed board. The flat cable 30 may be, by way of example, an FPC (Flexible Printed Circuit) or an FFC (Flexible Flat Cable).

Figure 1:
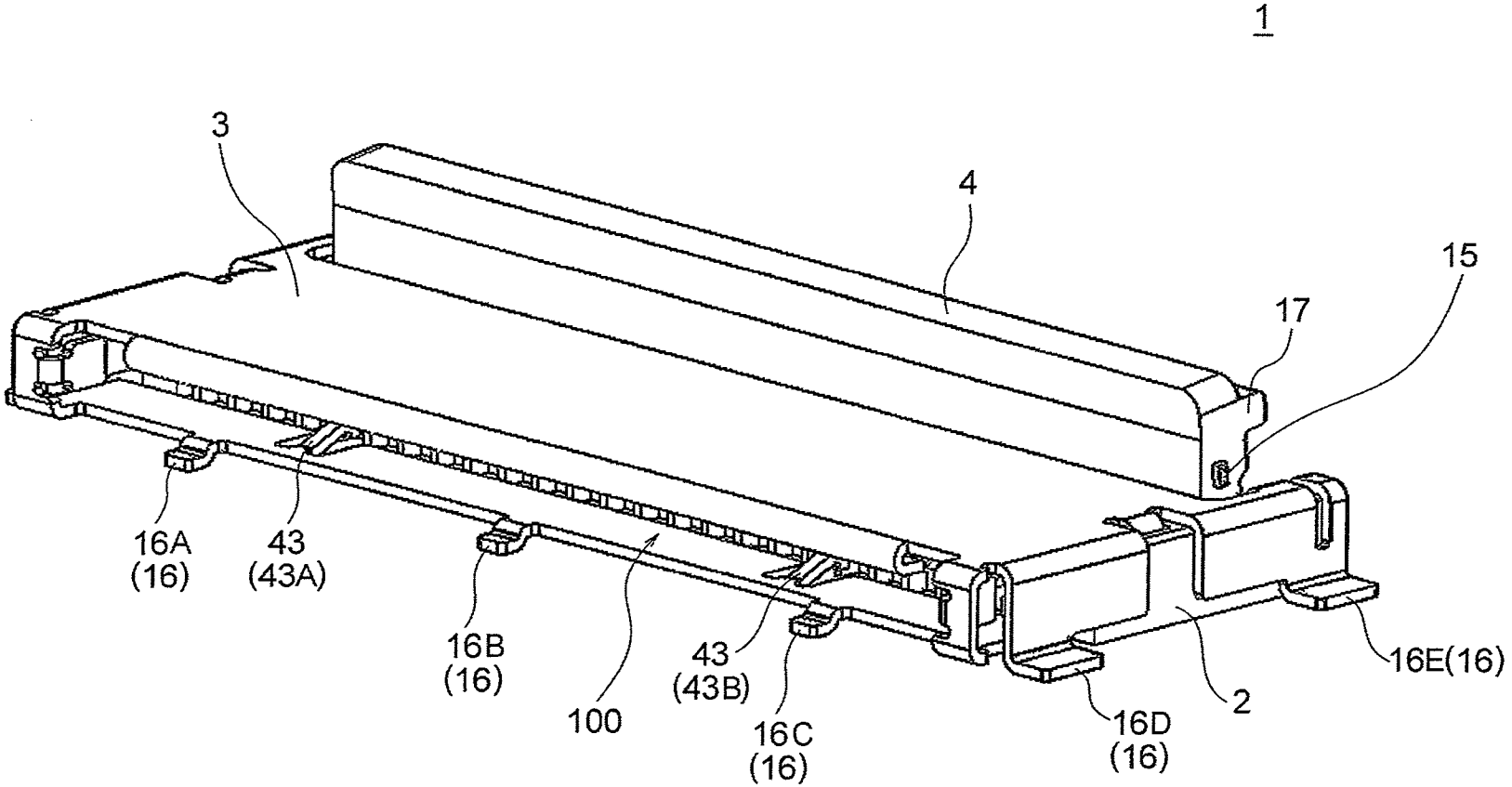
FIG. 1 is a perspective view of an electrical connector 1 according to an embodiment of this invention.

Referring to FIG. 1, the electrical connector 1 comprises a housing 2, a shield shell 3, and an actuator 4. As seen from the position and shape of the actuator 4, the electrical connector 1 is a so-called back-flip connector. The shield shell 3 has an end provided with an opening 100 for insertion of the flat cable 30 therethrough. A space surrounded by a plane defined by the opening 100, the housing 2, and the shield shell 3 will be referred to as an insertion portion 110. A forward end portion of the flat cable 30 inserted through the opening 100 is received in the insertion portion 110. The actuator 4 is upright in FIG. 1. The electrical connector 1 is configured such that if the flat cable 30 is inserted into the insertion portion 110 through the opening 100 while the actuator 4 is in the state shown in FIG. 1 and then if the actuator 4 is rotated to tilt to the right in FIG. 1, signal contacts 10 and 20 held by the housing 2 are brought into contact with a signal layer 32 of the flat cable 30 in response to the rotation of the actuator 4.

Figure 2:
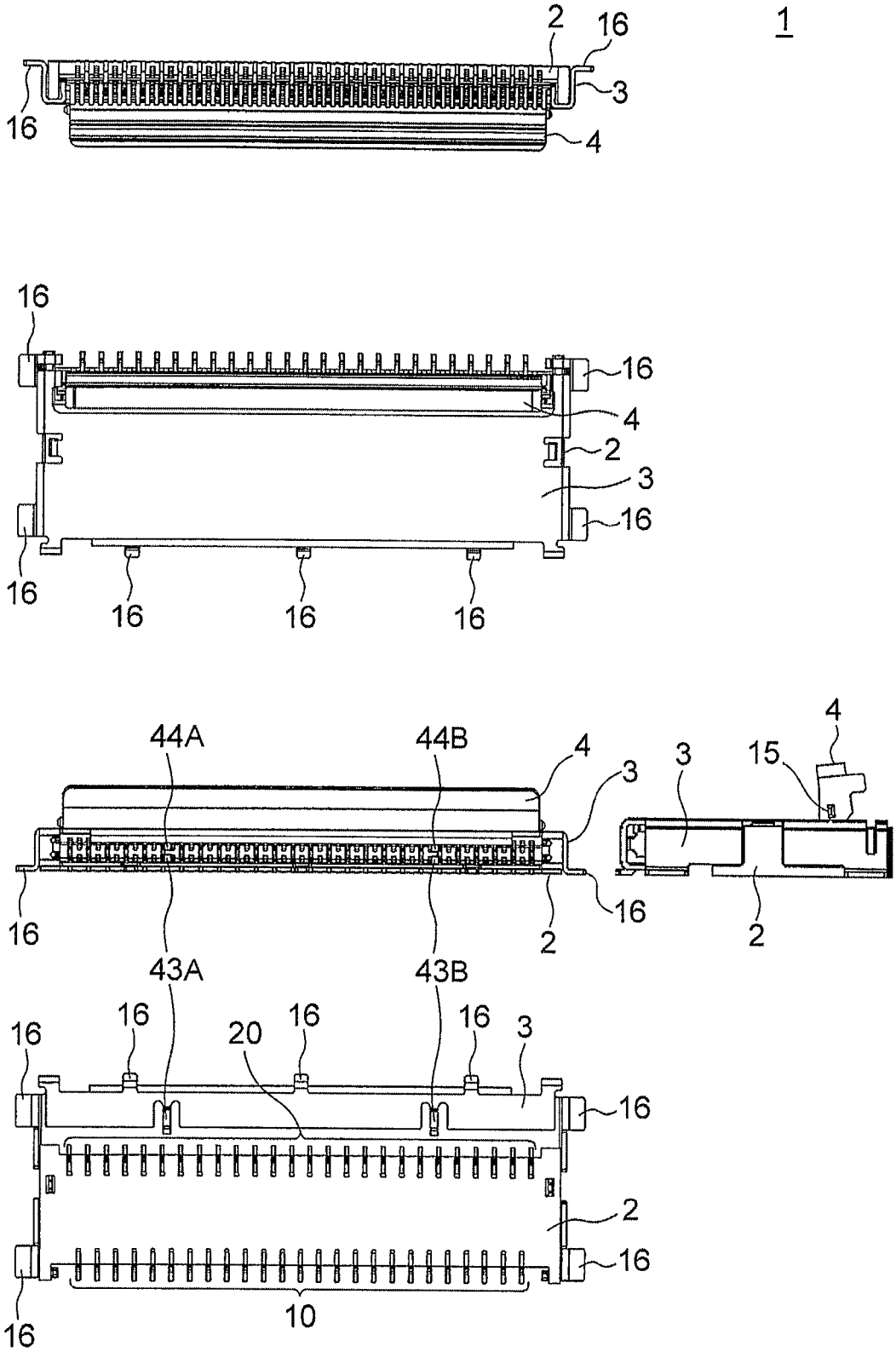
FIG. 2 shows a rear view, a top view, a front view, and a bottom view of the electrical connector 1 in this order from above, wherein a side view is shown on the right side of the front view.

As seen from FIG. 2, the signal contacts 10 and 20 are arranged in a row in the housing 2. Each of the signal contacts 10 and 20 is a transverse generally H-shaped component made of a conductor metal. One of left and right opening portions of the transverse generally H-shape of each signal contact 10, 20 faces the left in FIG. 1, i.e. the opening 100 side. The other opening portion of the transverse generally H-shape faces the right in FIG. 1, i.e. the actuator 4 side. In this specification, the opening 100 side from which the flat cable 30 is inserted will be referred to as the front of the electrical connector 1 while its opposite side, i.e. the side where the actuator 4 is provided, will be referred to as the rear of the electrical connector 1.

As shown in FIGS. 1, 3, 4, and 6, the flat cable 30 has contact portions 37 and 38 which are respectively brought into contact with the signal contacts 10 and 20 of the electrical connector 1. The contact portions 37 and 38 are arranged on one surface of the flat cable 30 at positions away from its forward end by two different predetermined distances. Specifically, the flat cable 30 has two rows, i.e. the row of the contact portions 38 arranged at the position close to the forward end of the flat cable 30 and the row of the contact portions 37 arranged at the position far from the forward end of the flat cable 30 compared to the row of the contact portions 38. The electrical connector 1 has the two kinds of the signal contacts 10 and 20 corresponding to these two rows of the contact portions 37 and 38.

Figure 3:
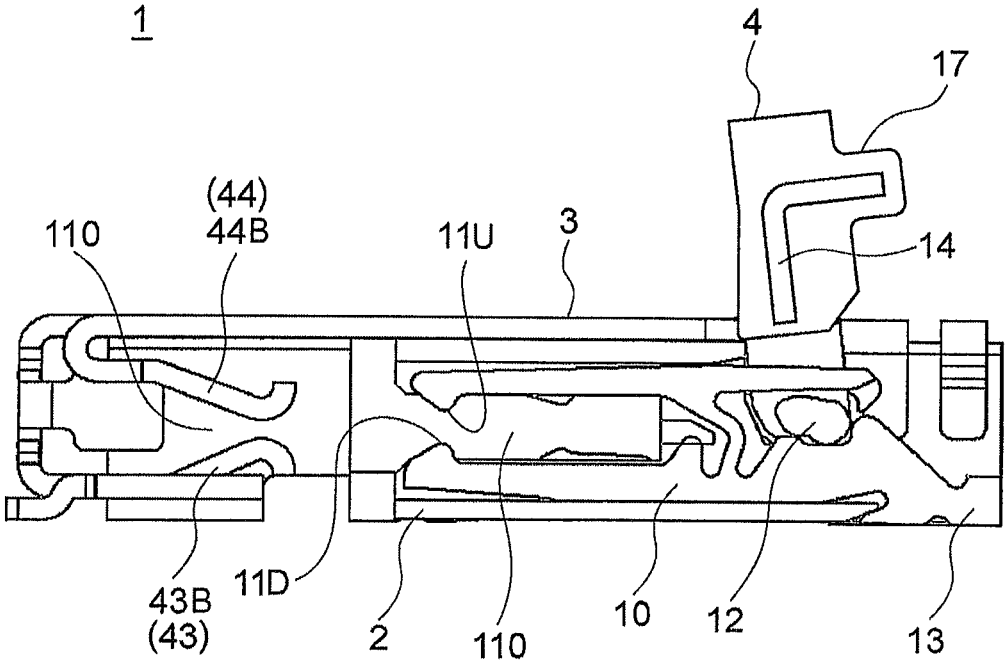
FIG. 3 is a cross-sectional view of the electrical connector 1 for explaining the structure of a first signal contact 10, wherein hatching for representing cross sections of components is omitted.

One of the two kinds is the first signal contacts 10 one of which is shown in FIG. 3. The first signal contacts 10 are signal contacts corresponding to the contact portion 37 row arranged on the side far from the forward end of the flat cable 30. Each first signal contact 10 has a pair of contact points 11U and 11D in the opening portion, located on the opening 100 side at the front of the electrical connector 1, of the transverse generally H-shape. The contact points 11U and 11D of each first signal contact 10 are for contact with the corresponding contact portion 37 of the contact portion 37 row arranged on the side far from the forward end of the flat cable 30. Herein, the reason for vertically providing the two contact points 11U and 11D is to allow either of the contact points 11U and 11D to be brought into contact with the contact portion 37 of the flat cable 30 regardless of a cable surface facing direction when the flat cable 30 is inserted. This will be clear by a description of the structure of the flat cable 30 which will be given later.

A portion corresponding to a vertical bar of the transverse generally H-shape of each first signal contact 10 is bent in a generally dogleg-shape in FIG. 3 and serves as a spring. The opening portion, located at the rear of the electrical connector 1, of the transverse generally H-shape of each first signal contact 10 receives therein a cam 12 forming part of a rotary shaft of the actuator 4. With this configuration, when the actuator 4 is tilted to the rear, the cams 12 rotate so that the opening portions at the rear of the first signal contacts 10 are opened while the opening portions at the front of the first signal contacts 10 are closed. As a result, one of the contact points 11U and 11D of each first signal contact 10 is pressed against the corresponding contact portion 37 of the flat cable 30. The other contact point of each first signal contact 10 is pressed against an insulating layer 35 of the flat cable 30. This will also be clear by the description of the structure of the flat cable 30 which will be given later.

Each first signal contact 10 has at its rear a terminal portion 13 which is adapted to be connected, by soldering or the like, to a corresponding one of connecting portions (not illustrated) provided on the printed board. While there is a possibility that electromagnetic waves are generated due to the connection between the printed board and the terminal portions 13 and so on to cause noise, the electromagnetic waves directed upward and rearward from the terminal portions 13 can be shielded by a shield plate 14 which will be described hereinbelow.

The actuator 4 is made of an insulating material such as a resin. The shield plate 14 is held in the actuator 4 by, for example, in-molding. The shield plate 14 is a member made of a conductive material, such as a metal plate. As shown in FIG. 3, the shield plate 14 is a beam-like member having a generally L-shape in cross section. Although not illustrated in FIG. 3, the shield plate 14 has a length corresponding to substantially the entire width of the actuator 4. The shield plate 14 has both ends each provided with an actuator terminal 15 protruding to the outside of the actuator 4.

While details will be described later, when the flat cable 30 is inserted and then the actuator 4 is tilted to the rear, the actuator terminals 15 are respectively brought into contact with actuator-terminal contact portions 42 provided at the rear of the shield shell 3. With this configuration, the shield plate 14 establishes paths electrically connected to ground connecting portions (not illustrated) on the printed board, mounted with the electrical connector 1, through the shield shell 3 and shell terminal portions 16A, 16B, and 16C and hold downs 16D, 16E, 16F, and 16G (hereinafter collectively referred to as "ground terminals 16" when it is not necessary to distinguish them from each other) provided to the shield shell 3. As a result, the shield plate 14 serves as a shield and thus can shield the electromagnetic waves directed upward and rearward from the terminal portions 13.

On the other hand, the electromagnetic waves directed forward from the terminal portions 13 are shielded by a top plate portion of the shield shell 3 and a shield layer 34 of the flat cable 30. The electromagnetic waves directed leftward and rightward (width directions of the electrical connector 1 and the flat cable 30) from the terminal portions 13 are shielded by side portions of the shield shell 3.

The reason why the shield plate 14 has the generally L-shape in cross section is to cover both upper surfaces of the terminal portions 13 and a rear surface of the electrical connector 1, when the actuator 4 is tilted to the rear.

In particular, in order to effectively shield the rear surface of the electrical connector 1 over its entire region in a height direction, the actuator 4 has a convex portion 17. In order to more effectively shield electromagnetic waves that are radiated in directions, from the terminal portions 13, over a range from the top plate portion of the electrical connector 1 to a portion where the electrical connector 1, mounted on the printed board, is in contact with the printed board, or electromagnetic waves that enter the electrical connector 1 from the outside, it is preferable to cover that range as much as possible with the shield plate 14. For this purpose, it is necessary that a lower end of the shield plate 14 be as close to the printed board as possible. The convex portion 17 is provided for allowing the lower end of the shield plate 14 to be as close to the printed board as possible when the actuator 4 is tilted to the rear. Naturally, it is preferable that the shield plate 14 extend as close to a distal end of the convex portion 17 as possible.

Since one of the objects of the shield plate 14 is to shield the electromagnetic waves radiated upward and rearward from the terminal portions 13 in the electrical connector 1, the shape of the shield plate 14 is satisfactory if it can cover both the upper and rear sides of the electrical connector 1. While, in this embodiment, the shield plate 14 has the beam-like shape with the generally L-shape in cross section, the shape of the shield plate 14 is not necessarily limited thereto. For example, the shield plate 14 may have a beam-like shape with a circular-arc cross section that can cover the electrical connector 1 from its upper to its rear-lower portion. Alternatively, the shield plate 14 may have a beam-like shape with a straight-line or curved-line cross section extending from an upper to a rear-lower portion of the electrical connector 1.

In addition to serving as the shield to shield the electromagnetic waves, the shield plate 14 also serves to enhance the mechanical strength of the actuator 4. A mobile telephone, for example, is a device in which the electrical connector 1 is mounted. This type of device is always required to be reduced in size and weight and, therefore, an electrical connector to be incorporated in the device is also inevitably required to be reduced in size and weight. On the other hand, the number of signal lines to be installed in an electrical connector tends to increase due to an increase in the number of sensors to be mounted in the device and the increase in the number of signal lines leads to an increase in the width of the electrical connector and thus to an increase in the width of an actuator. That is, the actuator is required to be wider and smaller/lighter. Under these circumstances, a problem tends to occur that when the actuator is operated, the actuator is subjected to mechanical damage such as breaking or bending and comes off a housing. In the electrical connector 1, such a problem is made difficult to occur by incorporating the shield plate 14 in the actuator 4.

Figure 4:
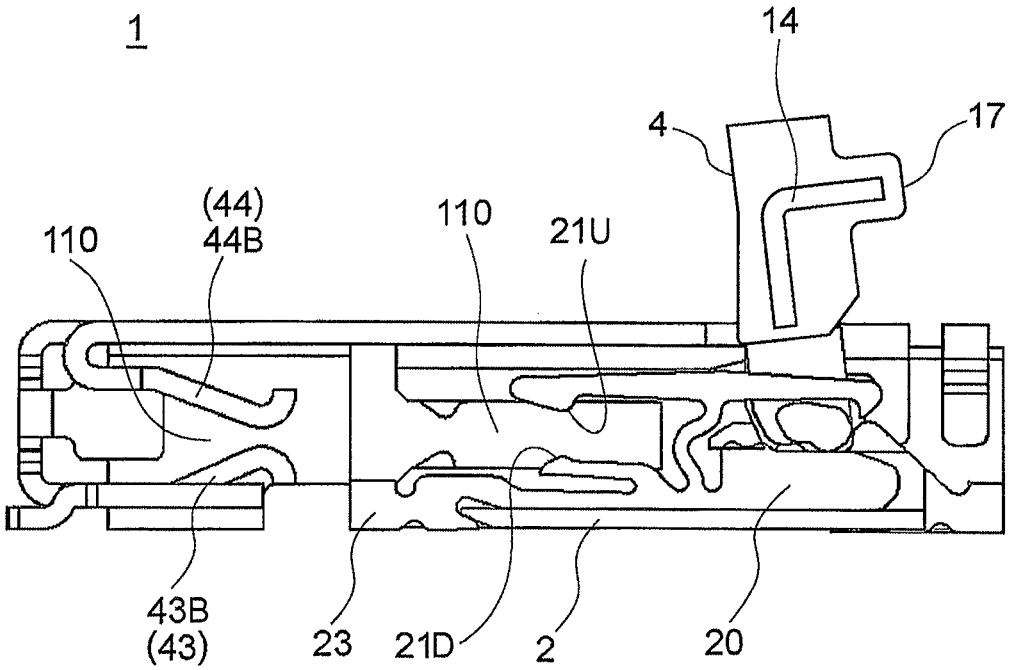
FIG. 4 is a cross-sectional view of the electrical connector 1 for explaining the structure of a second signal contact 20, wherein hatching for representing cross sections of components is omitted.

The other of the above-mentioned two kinds is the second signal contacts 20 one of which is shown in FIG. 4. The second signal contacts 20 are signal contacts corresponding to the contact portion 38 row arranged on the side close to the forward end of the flat cable 30. Each second signal contact 20 has a pair of contact points 21U and 21D in the opening portion, located on the opening 100 side at the front of the electrical connector 1, of the transverse generally H-shape. The contact points 21U and 21D of each second signal contact 20 are for contact with the corresponding contact portion 38 of the contact portion 38 row arranged on the side close to the forward end of the flat cable 30.

A portion corresponding to a vertical bar of the transverse generally H-shape of each second signal contact 20 is bent in a generally dogleg-shape in FIG. 4 and serves as a spring. The opening portion, located at the rear of the electrical connector 1, of the transverse generally H-shape of each second signal contact 20 receives therein a cam 12. With this configuration, when the actuator 4 is tilted to the rear, the cams 12 rotate so that the opening portions at the rear of the second signal contacts 20 are opened while the opening portions at the front of the second signal contacts 20 are closed. As a result, one of the contact points 21U and 21D of each second signal contact 20 is pressed against the corresponding contact portion 38 of the contact portion 38 row arranged on the side close to the forward end of the flat cable 30. The other contact point of each second signal contact 20 is pressed against the insulating layer 35 of the flat cable 30.

Each second signal contact 20 has at its front a terminal portion 23 which is adapted to be connected, by soldering or the like, to a corresponding one of connecting portions (not illustrated) provided on the printed board. Electromagnetic waves caused by the connection between the printed board and the terminal portions 23 and so on are shielded as follows. The electromagnetic waves directed forward and upward in the electrical connector 1 are shielded by the top plate portion of the shield shell 3 and the shield layer 34 of the flat cable 30. The electromagnetic waves directed leftward and rightward in the electrical connector 1 are shielded by the side portions of the shield shell 3. The electromagnetic waves directed rearward in the electrical connector 1 are shielded by the shield plate 14.

Figure 5:
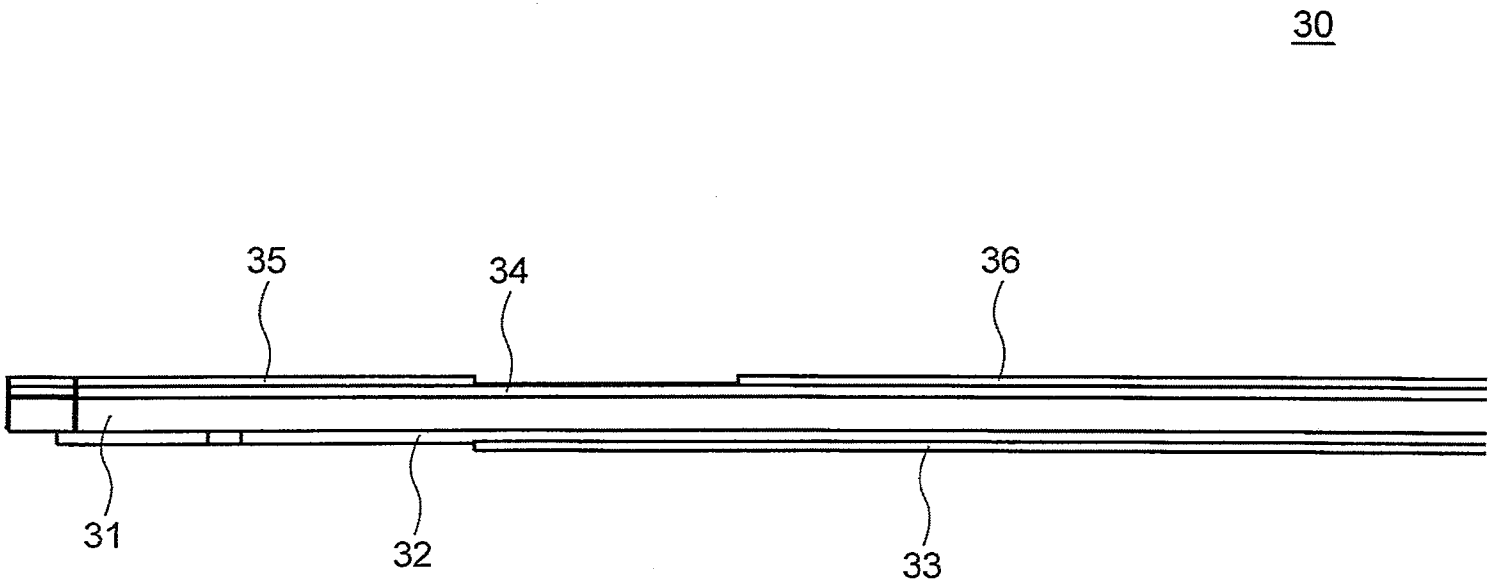
FIG. 5 is a cross-sectional view for explaining the structure of a flat cable 30, wherein hatching for representing cross sections of components is omitted.

Next, the structure of the flat cable 30 will be described. Referring to FIG. 5, the flat cable 30 has, on the lower side in FIG. 5 of a base member (base layer) 31, the signal layer 32 as a conductor layer made of a copper foil or the like and an insulating layer 33 under the signal layer 32. Further, on the upper side in FIG. 5 of the base member 31, the flat cable 30 has the ground layer (shield layer) 34 as a conductor layer made of a copper foil or the like and the insulating layers 35 and 36 covering the ground layer 34.

The signal layer 32 and the ground layer 34 are each partially exposed for electrical connection to the electrical connector 1. On the lower side in FIG. 5 of the base member 31, the insulating layer 33 does not extend to the forward end of the flat cable 30 so that the signal layer 32 is exposed at its forward end. On the other hand, on the upper side in FIG. 5 of the base member 31, the insulating layer 35 and the insulating layer 36 are spaced apart from each other so that the ground layer 34 is exposed at this spaced-apart portion between the insulating layers 35 and 36.

As shown in FIG. 5, the position where the signal layer 32 is exposed on the lower side of the base member 31 and the position where the ground layer 34 is exposed on the upper side of the base member 31 are offset from each other. By offsetting the exposed positions on the base member 31, even if the flat cable 30 is inserted into the electrical connector 1 with either surface of the flat cable 30 facing upward or downward, the signal layer 32 is always brought into contact with both of the first and second signal contacts 10 and 20 while the ground layer 34 is connected to the shield shell 3 through ground springs 43 or 44 provided forward of the first signal contacts 10 in the electrical connector 1.

Figure 6:
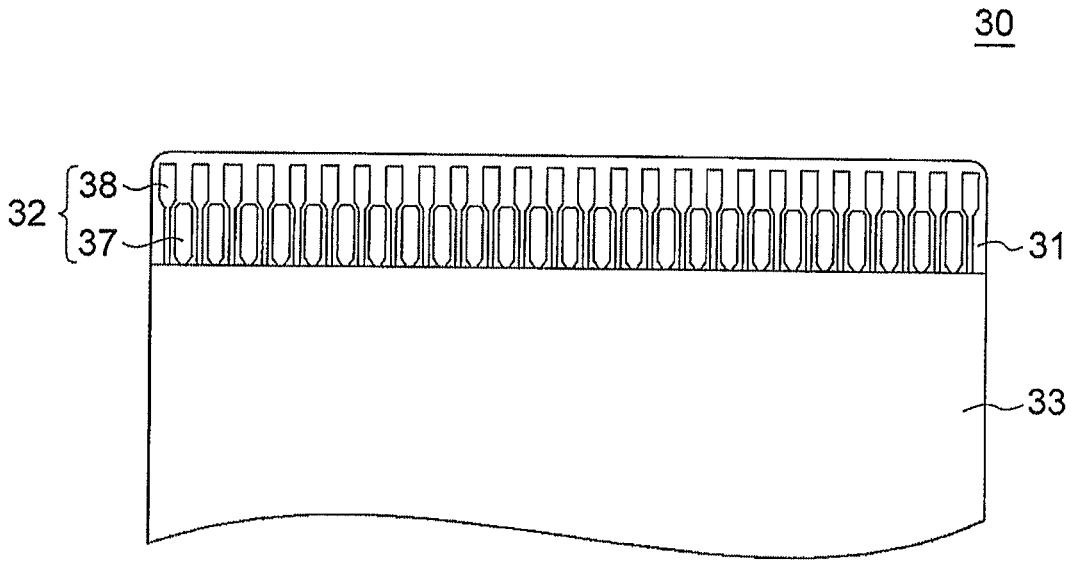
FIG. 6 is a plan view for explaining a forward end portion of the flat cable 30 as seen from the signal layer 32 side.
Figure 7:
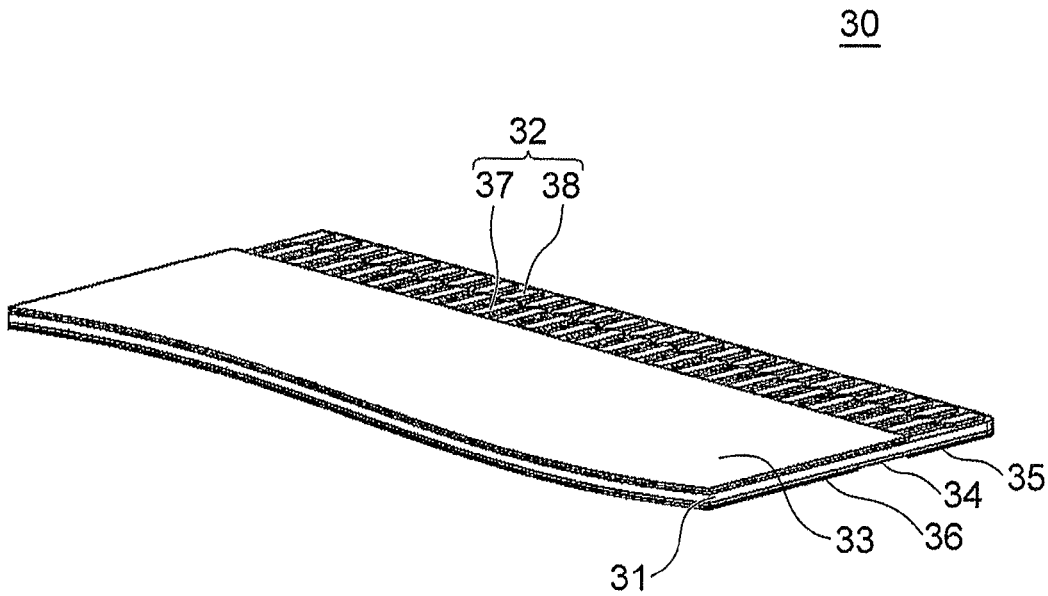
FIG. 7 is a perspective view for explaining the forward end portion of the flat cable 30 as seen from the signal layer 32 side.

Referring to FIGS. 6 and 7, the signal layer 32 comprises a plurality of conductive lines. At the forward end of the flat cable 30, the conductive lines are respectively provided with the contact portions 37 and 38 for contact with the contact points of the electrical connector 1. These contact portions 37 and 38 are arranged in two rows on the rear and front sides as seen from the forward end of the flat cable 30.

On the rear side as seen from the forward end of the flat cable 30, i.e. on the front side for the electrical connector 1 to be connected, the first signal layer contact portions 37 are arranged side by side at 25 positions in one row extending in the width direction of the flat cable 30. When the flat cable 30 is inserted into the electrical connector 1 and then the actuator 4 is tilted to the rear, each first signal layer contact portion 37 is brought into contact with the corresponding first signal contact 10 through one of the contact points 11U and 11D, thereby establishing an electrically conductive path. Which of the contact points is used depends on a cable surface facing direction when the flat cable 30 is inserted.

On the front side as seen from the forward end of the flat cable 30, i.e. on the rear side for the electrical connector 1 to be connected, the second signal layer contact portions 38 are arranged side by side at 26 positions in one row extending in the width direction of the flat cable 30. When the flat cable 30 is inserted into the electrical connector 1 and then the actuator 4 is tilted to the rear, each second signal layer contact portion 38 is brought into contact with the corresponding second signal contact 20 through one of the contact points 21U and 21D, thereby establishing an electrically conductive path. Which of the contact points is used depends on a cable surface facing direction when the flat cable 30 is inserted.

Figure 8:
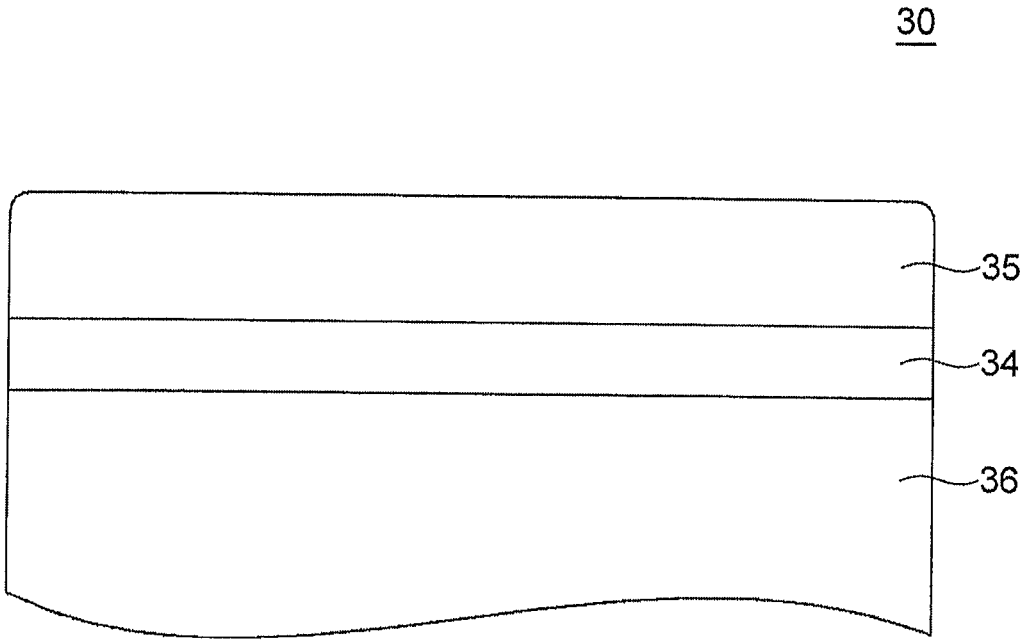
FIG. 8 is a diagram for explaining a forward end portion of the flat cable 30 as seen from the ground layer 34 side.
Figure 9:
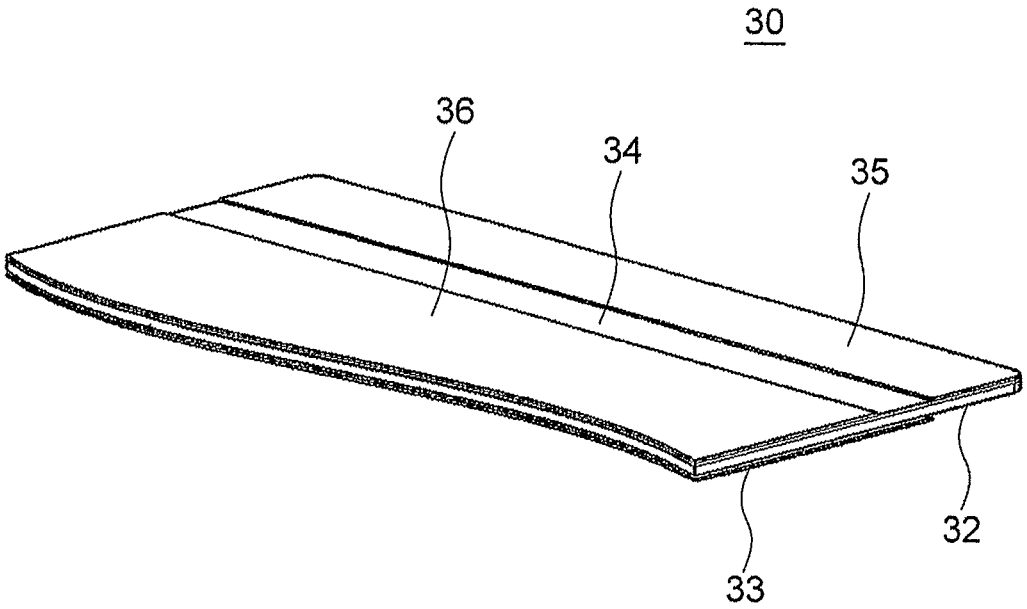
FIG. 9 is a perspective view for explaining the forward end portion of the flat cable 30 as seen from the ground layer 34 side.

As shown in FIGS. 8 and 9, the ground layer 34 is exposed in a belt-like shape at a position of a predetermined distance from the forward end of the flat cable 30. The position where the ground layer 34 is exposed is further away from the forward end of the flat cable 30 compared to the position of the row of the first signal layer contact portions 37 provided on the opposite side of the flat cable 30. The exposed portion of the ground layer 34 is brought into contact with the ground springs 43 or 44 provided forward of the first signal contacts 10 in the electrical connector 1.

Figure 10:
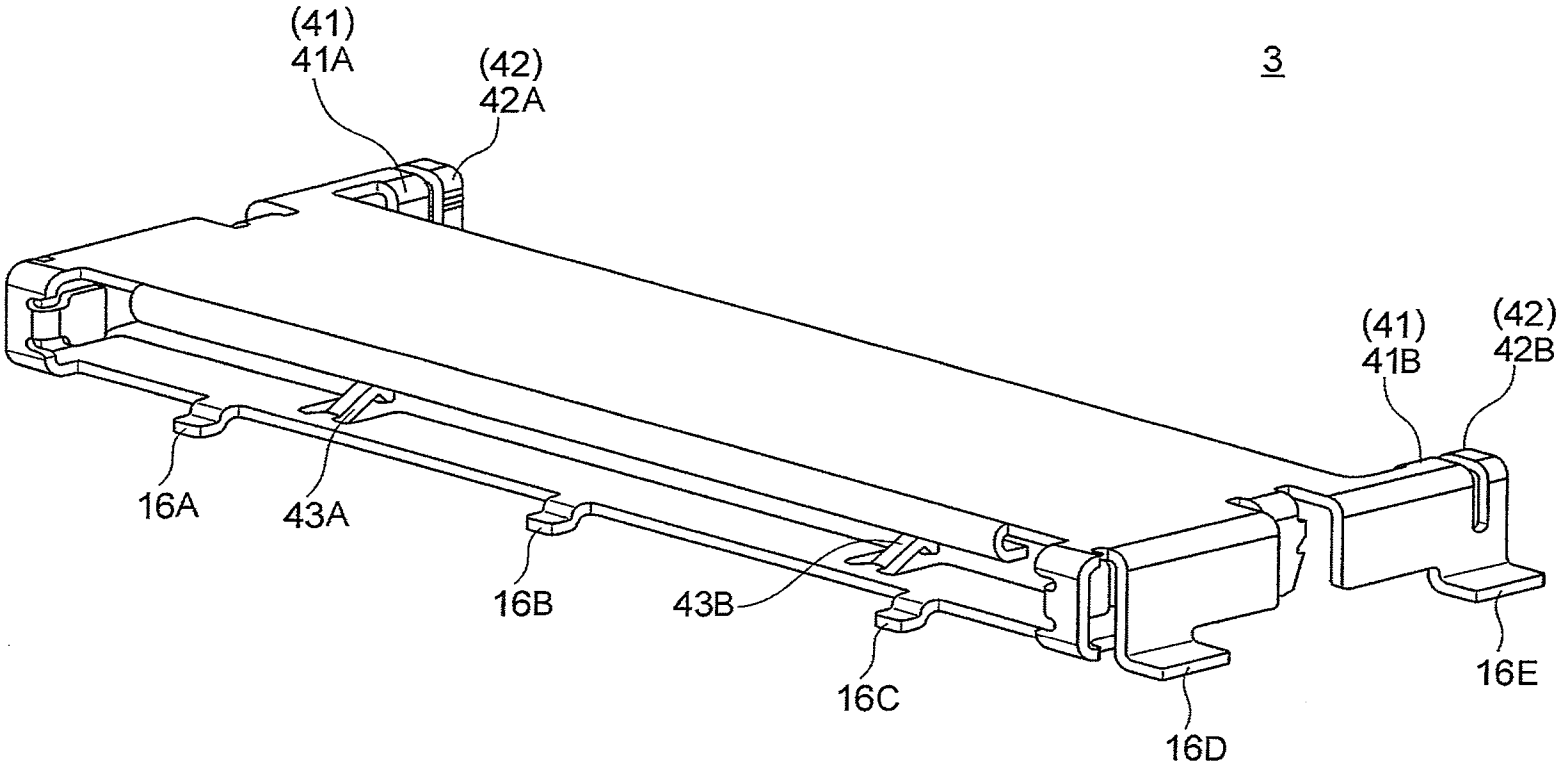
FIG. 10 is a perspective view for explaining the structure of a shield shell 3.
Figure 11:
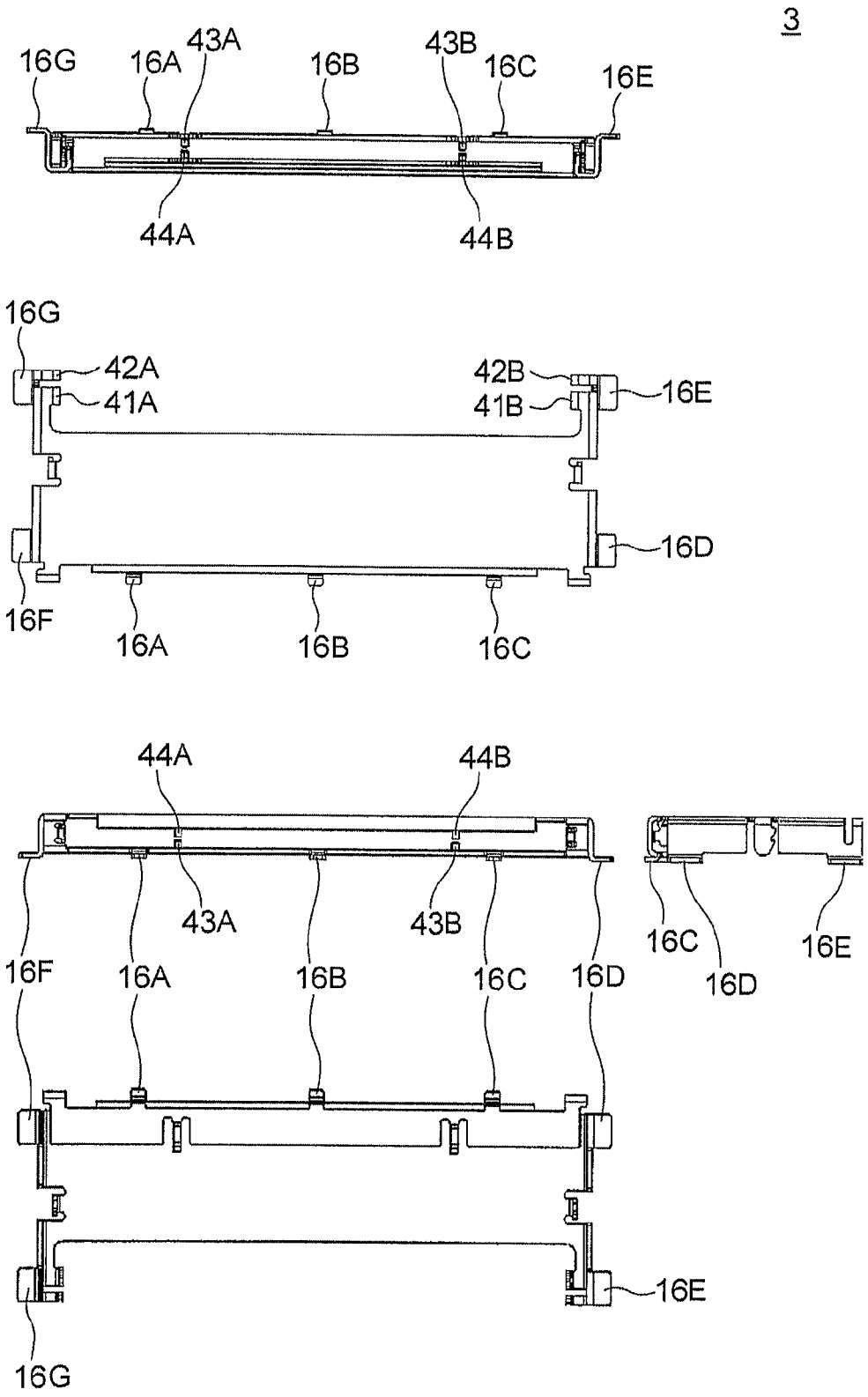
FIG. 11 shows a rear view, a top view, a front view, and a bottom view of the shield shell 3 in this order from above, wherein a side view is shown on the right side of the front view.

Next, the shield shell 3 will be described. The shield shell 3 is formed by punching a single metal plate into a predetermined shape and then bending the punched metal plate. Referring to FIGS. 10 and 11, the shield shell 3 comprises the shell terminal portions 16A, 16B, and 16C, the holddowns 16D, 16E, 16F, and 16G, cover portions 41A and 41B, and actuator-terminal contact portions 42A and 42B as the above-mentioned actuator-terminal contact portions 42. Further, the shield shell 3 comprises first ground springs 43A and 43B and second ground springs 44A and 44B as the above-mentioned ground springs 43 and 44.

As shown in FIGS. 3 and 4, the first ground springs 43A and 43B each have a structure in which part of the metal plate forming the shield shell 3 is bent upward in FIGS. 3 and 4 and its free end is further bent downward in FIGS. 3 and 4. The first ground springs 43A and 43B each generate an elastic force due to the bending at its root. When the flat cable 30 is inserted into the electrical connector 1, these elastic forces act as forces to press the first ground springs 43A and 43B themselves against the flat cable 30, particularly against the exposed ground layer 34. Further, by bending the free ends of the first ground springs 43A and 43B, it is possible to smoothly insert and pull out the flat cable 30 even in the state where the first ground springs 43A and 43B are pressed against the flat cable 30. Hereinafter, the first ground springs 43A and 43B will be referred to as "first ground springs 43" when it is not necessary to distinguish them from each other.

The second ground springs 44A and 44B are the same as the first ground springs 43A and 43B except that the up and down directions are reversed. Hereinafter, the second ground springs 44A and 44B will be referred to as "second ground springs 44" when it is not necessary to distinguish them from each other. Each second ground spring 44 is formed in the following manner. Referring to FIGS. 3 and 4, the top plate portion of the shield shell 3 is first bent at its front toward the inside of the insertion portion 110 of the electrical connector 1 so as to be substantially parallel to the non-bent top plate portion, then this bent portion of the metal plate is slit to form a bendable portion, and then this bendable portion is bent downward to serve as the second ground spring 44. This downward bending acts as a spring to generate a force to press the second ground spring 44 against the flat cable 30, particularly against the exposed ground layer 34. Since each second ground spring 44 is also bent at its free end, it is possible to smoothly insert and pull out the flat cable 30 even in the state where the second ground springs 44 are pressed against the flat cable 30.

When the flat cable 30 is attached to the electrical connector 1, the first ground springs 43 or the second ground springs 44 are brought into contact with the exposed ground layer 34 depending on a cable surface facing direction of the flat cable 30. It is assumed that the flat cable 30 is attached to the electrical connector 1 of FIG. 1 with a cable surface facing direction shown in FIG. 5. In this event, the second ground springs 44 are brought into contact with the exposed ground layer 34. The first ground springs 43 are brought into contact with the insulating layer 33 at a portion corresponding to the back side of the exposed portion of the ground layer 34. Conversely, when the flat cable 30 is attached to the electrical connector 1 of FIG. 1 with a cable surface facing direction reverse to that shown in FIG. 5, the first ground springs 43 are brought into contact with the exposed ground layer 34 while the second ground springs 44 are brought into contact the insulating layer 33.

Figure 12:
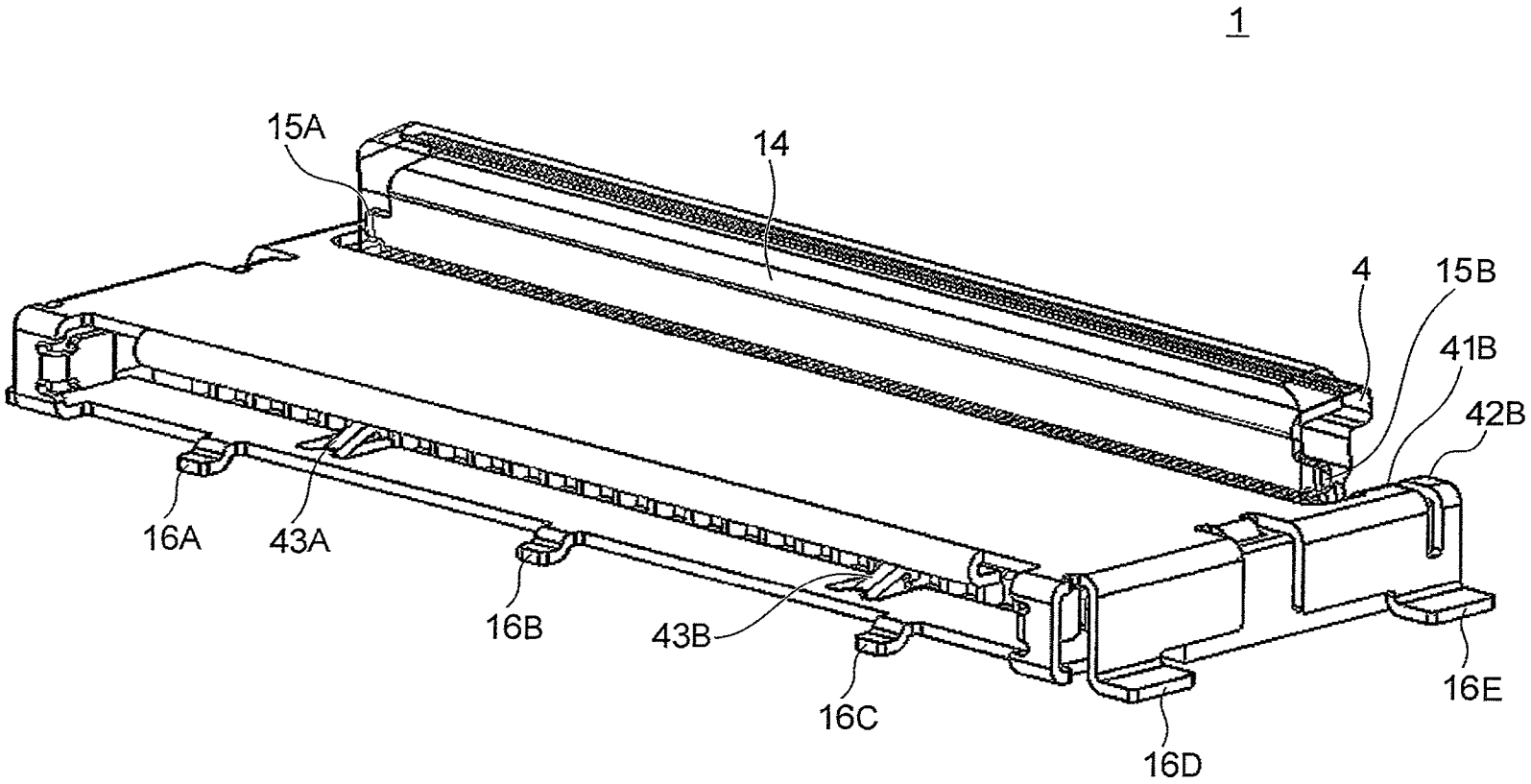
FIG. 12 is a perspective view of the electrical connector 1, wherein a shield plate 14 is shown as seen through an actuator 4.

The shield plate 14 incorporated in the actuator 4 will be described with reference to FIG. 12. In FIG. 12, the actuator 4 is illustrated in a transparent manner for the purpose of describing the shape of the shield plate 14 and so on. As shown in FIG. 12, the shield plate 14 has a beam-like shape with a generally L-shape in cross section. Both ends of the shield plate 14 protrude from the actuator 4 and serve as actuator terminals 15A and 15B, respectively.

Figure 13:
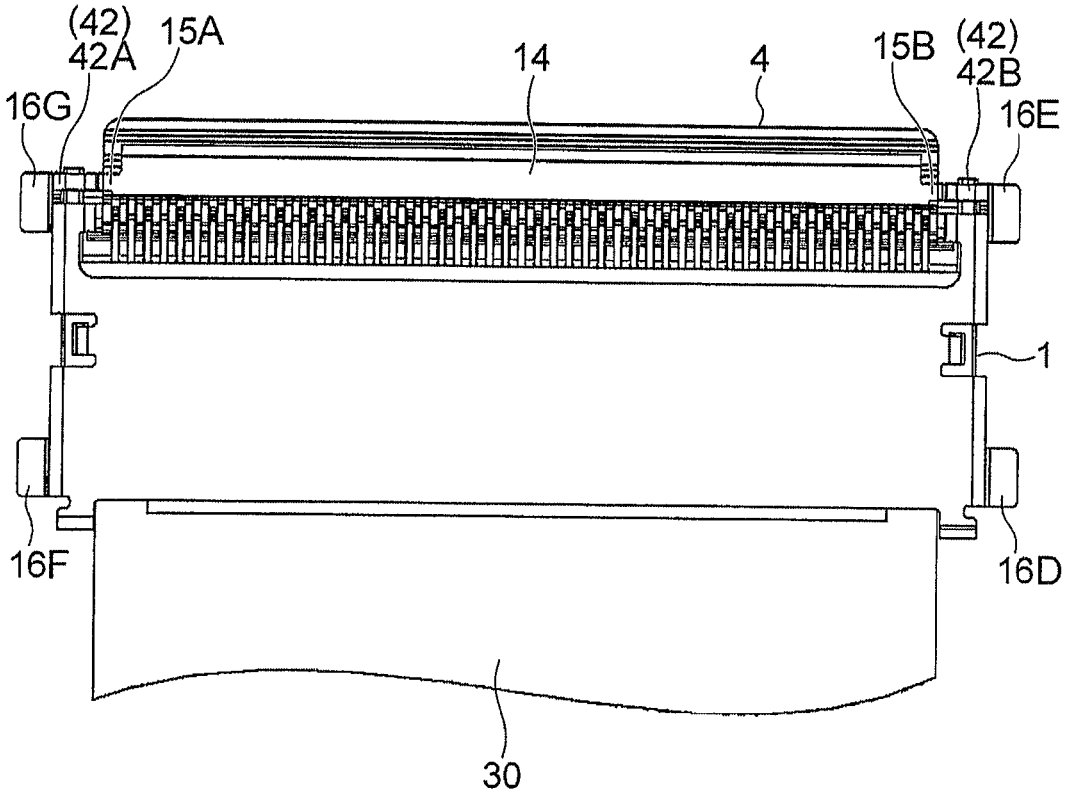
FIG. 13 is a diagram, as seen from above, of the electrical connector 1 in a state where the flat cable 30 is inserted into the electrical connector 1 and the actuator 4 shown in a see-through manner is tilted to the rear, and is a diagram for explaining that, in this event, electrical paths are established between the shield plate 14 and ground terminals 16.
Figure 14:
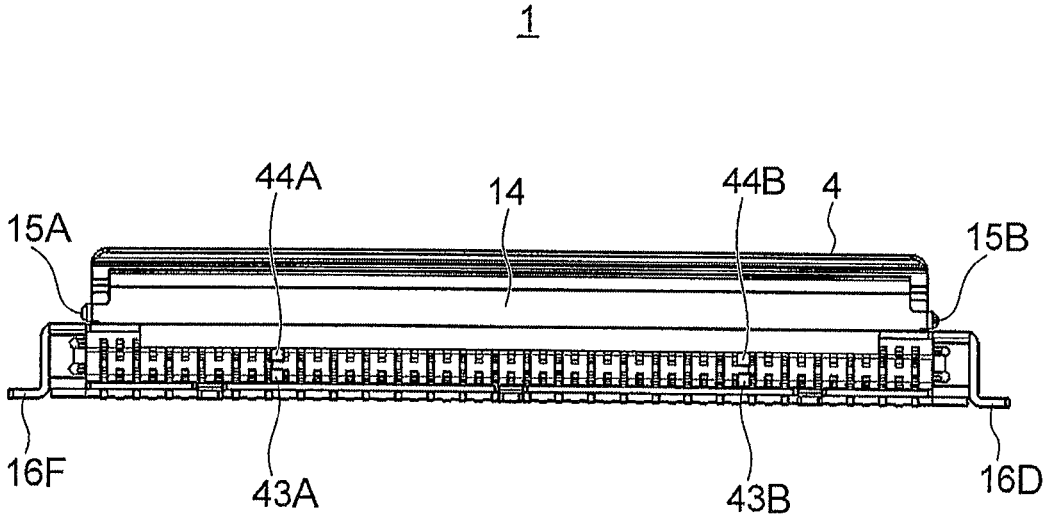
FIG. 14 is a front view of the electrical connector 1, wherein the actuator 4 is shown in a see-through manner.

As shown in FIG. 13, the actuator terminals 15A and 15B are respectively brought into contact with the actuator-terminal contact portions 42A and 42B when the actuator 4 is tilted to the rear. By this contact, the shield plate 14 establishes an electrical path to the ground connecting portion (not illustrated) on the printed board, mounted with the electrical connector 1, through the actuator terminal 15A, the actuator-terminal contact portion 42A, and one of the ground terminals 16, for example, the nearest holddown 16G. This is the same for the actuator terminal 15B, the actuator-terminal contact portion 42B, and the holddown 16E. On the other hand, as shown in FIG. 14, when the actuator 4 is upright, the actuator terminals 15 protrude in the air and are in a non-contact state with the actuator-terminal contact portions 42.

Next, the positional relationship among the terminal portion 13 of each first signal contact 10, a signal wiring pattern (not illustrated) on the printed board, and the shield plate 14 will be described.

First, the positional relationship will be described when the actuator 4 is in the upright state. Herein, let be considered a group of imaginary straight lines extending radially from the terminal portion 13 as a starting point. These radial lines respectively represent electromagnetic waves radiated from a connecting portion between the first signal contact 10 of the electrical connector 1 and the signal wiring pattern on the printed board mounted with the electrical connector 1. In FIGS. 15 to 18, an advancing direction of an electromagnetic wave that advances directly upward from the terminal portion 13 and an advancing direction of an electromagnetic wave that advances obliquely rearward from the terminal portion 13 are respectively indicated by dotted lines 51 and 52 each with an arrow at its end.

Figure 15:
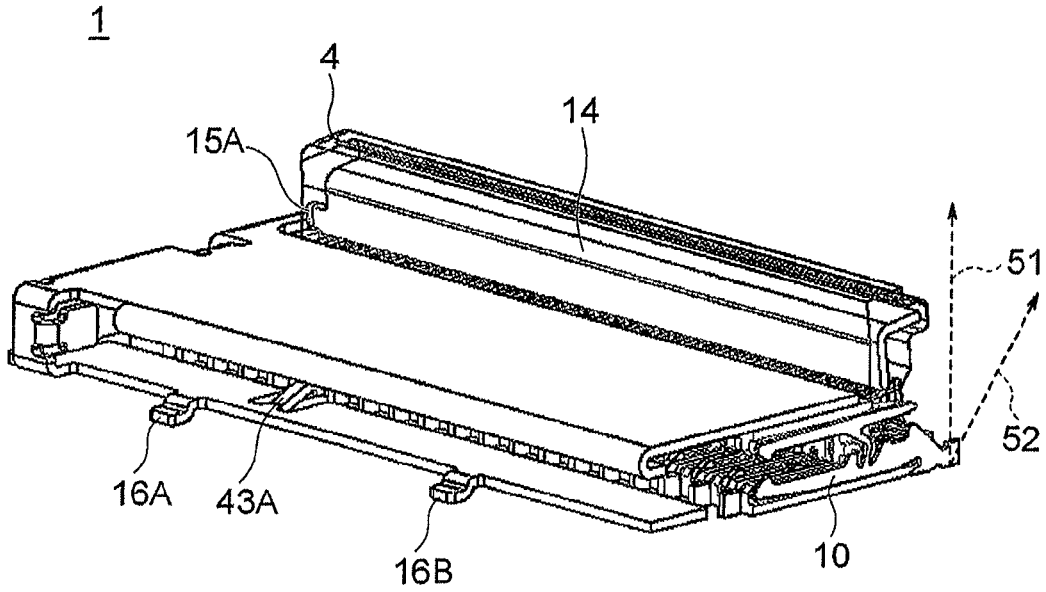
FIG. 15 is a cross-sectional perspective view of the electrical connector 1, taken at a position of a first signal contact 10, for explaining the shield plate 14 when the actuator 4 is in an upright state, wherein the actuator 4 is shown in a see-through manner and hatching for representing cross sections of components is omitted.
Figure 16:
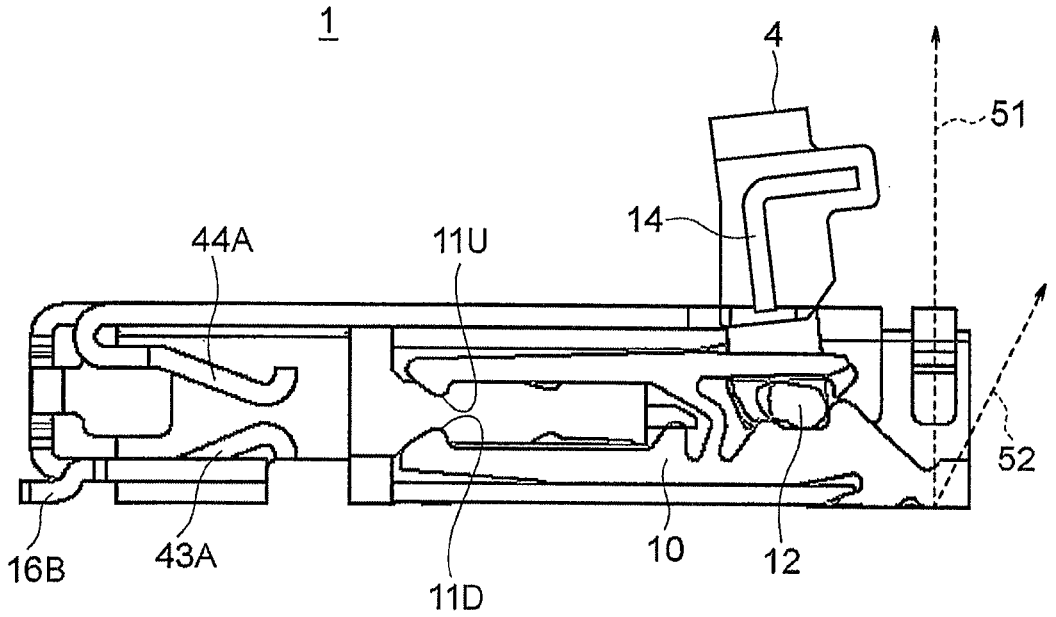
FIG. 16 is a cross-sectional view of the electrical connector 1 corresponding to the cross-sectional perspective view of FIG. 15, wherein hatching for representing cross sections of components is omitted.
Figure 17:
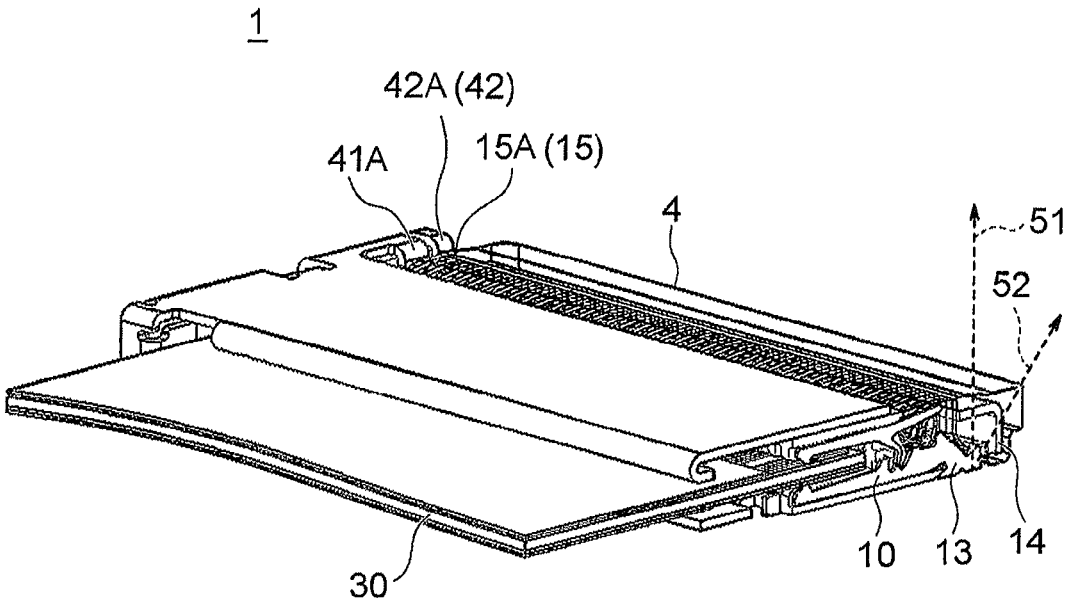
FIG. 17 is a cross-sectional perspective view of the electrical connector 1 and the flat cable 30, taken at a position of a first signal contact 10, for explaining the shield plate 14 in a state where the actuator 4 is tilted to the rear, wherein the actuator 4 is shown in a see-through manner and hatching for representing cross sections of components is omitted.
Figure 18:
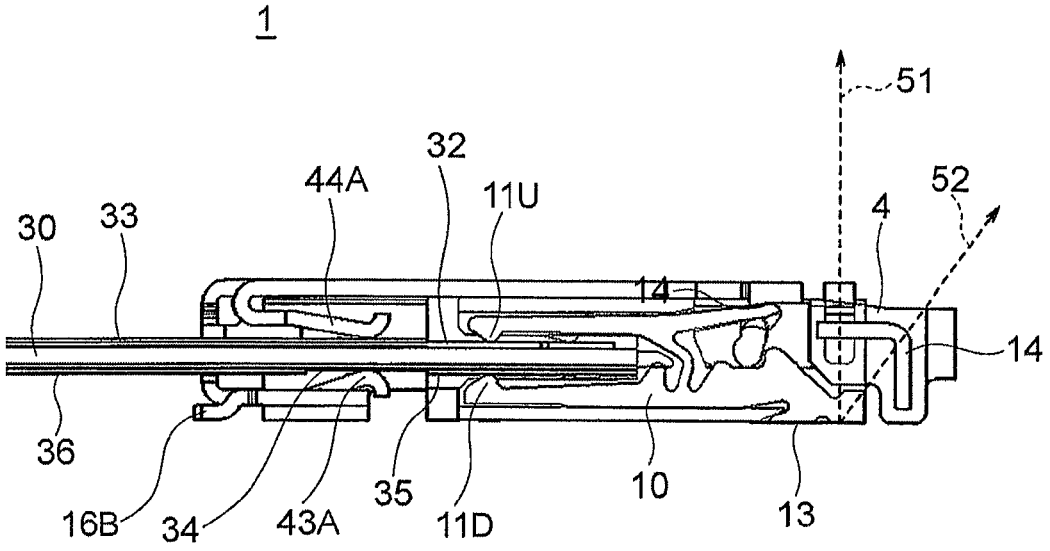
FIG. 18 is a cross-sectional view of the electrical connector 1 and the flat cable 30 corresponding to the cross-sectional perspective view of FIG. 17, wherein hatching for representing cross sections of components is omitted.

As seen from FIGS. 15 and 16, when the actuator 4 is in the upright state, the dotted lines 51 and 52 advance without being shielded by the shield plate 14. However, when the actuator 4 is in the upright state, the flat cable 30 is not attached to the electrical connector 1. Even if the flat cable 30 is inserted in the electrical connector 1, when the actuator 4 is in the upright state, the cams 12 are not in a position to close the contact points 11U and 11D of the first signal contacts 10 so that all the contact points 11U and 11D are in a non-contact state with the signal layer 32 of the flat cable 30. Therefore, when the actuator 4 is in the upright state, no electromagnetic wave is generated from any of the terminal portions 13.

On the other hand, it is assumed that the flat cable 30 is attached to the electrical connector 1 by inserting the flat cable 30 into the electrical connector 1 and then tilting the actuator 4 to the rear. Herein, referring to FIGS. 17 and 18, a description will be given of a state where the flat cable 30 is inserted with the signal layer 32 facing upward in FIGS. 17 and 18 and with the ground layer 34 facing downward in FIGS. 17 and 18.

In this event, the cams 12 rotate in response to the rotation of the actuator 4 so that the contact points 11U and 11D of the first signal contacts 10 sandwich the flat cable 30 therebetween. Consequently, the contact point 11U of each first signal contact 10 is brought into contact with a corresponding one of the first signal layer contact portions 37, shown in FIG. 7, in the signal layer 32 of the flat cable 30. The contact point 11D of each first signal contact 10 is brought into contact with the insulating layer 35 on the ground layer 34 side. In this manner, the signal line of the flat cable 30 and the corresponding signal contact of the electrical connector 1 are brought into contact with each other, thereby establishing an electrical path to the corresponding signal wiring pattern (not illustrated) on the printed board through the terminal portion 13.

On the other hand, the first ground springs 43 and the second ground springs 44 are pressed against the surfaces of the inserted flat cable 30 due to elastic forces thereof. Consequently, the first ground springs 43 are brought into contact with the ground layer 34 while the second ground springs 44 are brought into contact with the insulating layer 33 on the signal layer 32 side. In this manner, the ground layer 34 of the flat cable 30 is electrically connected to the ground connecting portions (not illustrated) on the printed board through the first ground springs 43 and the ground terminals 16.

Further, in response to the rotation of the actuator 4, the actuator terminals 15 are respectively brought into contact with the actuator-terminal contact portions 42. Consequently, electrical paths connecting between the shield plate 14 and the ground connecting portions (not illustrated) on the printed board are established so that the shield plate 14 serves as a shield to shield the electromagnetic waves. In this event, the electromagnetic wave advancing directly upward from each terminal portion 13 hits the shield plate 14 as indicated by the dotted line 51. Likewise, the electromagnetic wave advancing obliquely rearward from each terminal portion 13 hits the shield plate 14 as indicated by the dotted line 52. Accordingly, the electromagnetic waves advancing in the directions of the dotted lines 51 and 52 are both shielded by the shield plate 14. Further, electromagnetic waves that enter the electrical connector 1 at the terminal portions 13 from the outside are also shielded by the shield plate 14.

Next, the contact between each actuator terminal 15 and the corresponding actuator-terminal contact portion 42 will be described with reference to FIGS. 19, 20, and 21. The actuator-terminal contact portion 42 is part of the shield shell 3. The actuator-terminal contact portion 42 is formed by bending the metal plate, forming the shield shell 3, so as to wrap a side wall 61 standing upright at an end of the housing 2 and has a convex portion 62 (62A, 62B) and a concave portion 63 (63A, 63B). Since the actuator-terminal contact portion 42 is formed by bending the metal plate, it serves as a spring.

Figure 19:
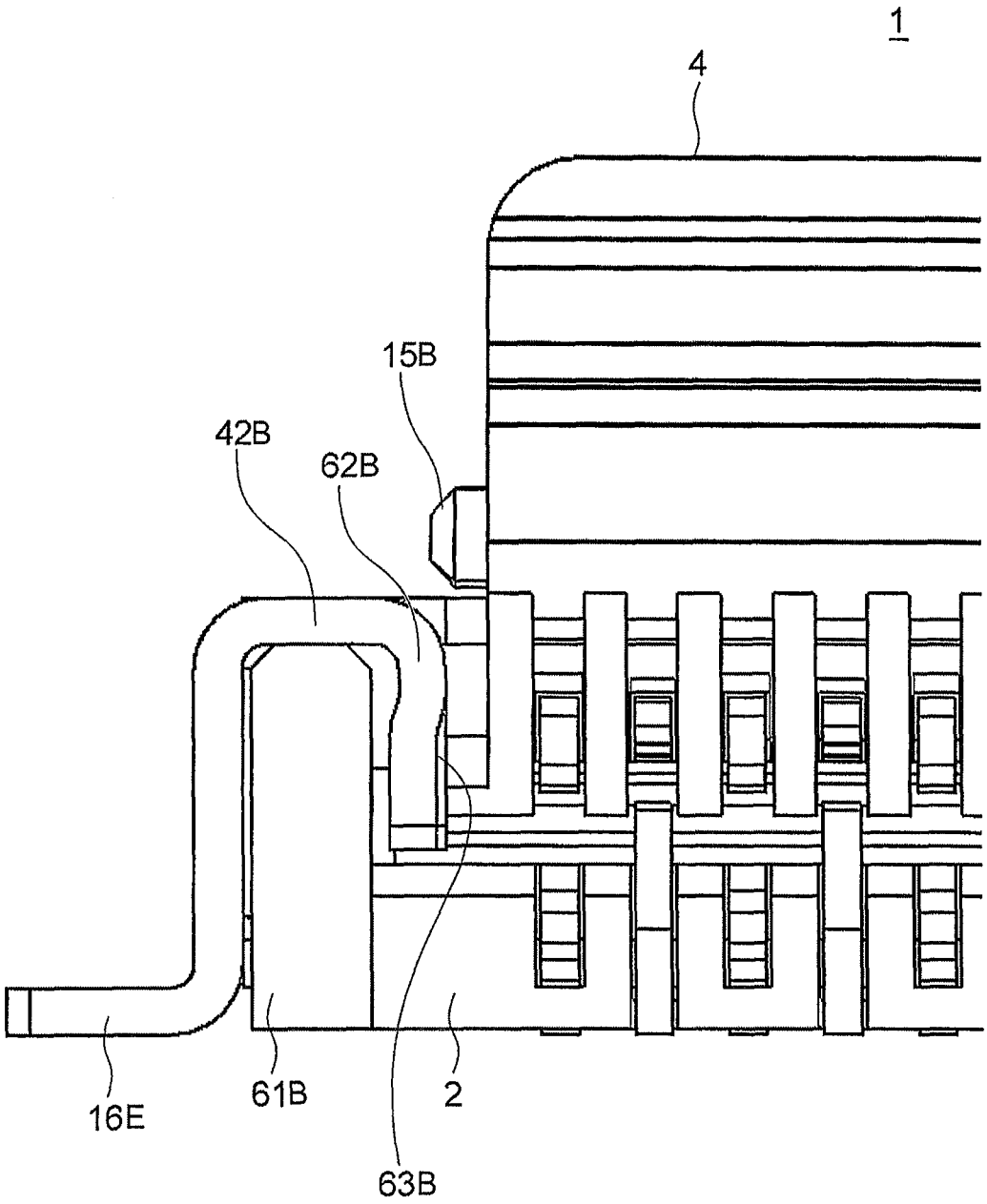
FIG. 19 is a rear view of the electrical connector 1 for explaining the cooperation of the contact between an actuator terminal 15 and an actuator-terminal contact portion 42 with the rotation of the actuator 4 and is a diagram showing a state where the actuator 4 is in the upright state.
Figure 20:
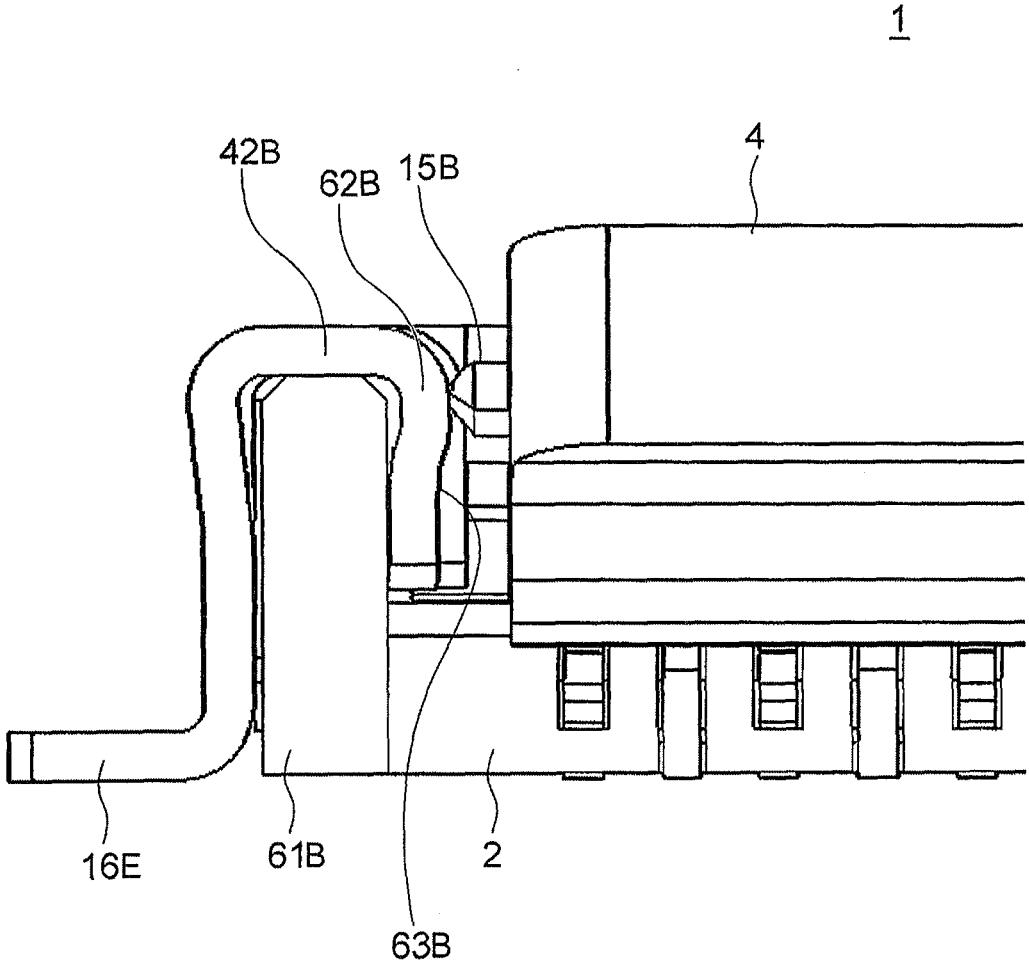
FIG. 20 is a rear view of the electrical connector 1 for explaining the cooperation of the contact between the actuator terminal 15 and the actuator-terminal contact portion 42 with the rotation of the actuator 4 and is a diagram showing a state where the actuator 4 is on the way of tilting to the rear.
Figure 21:
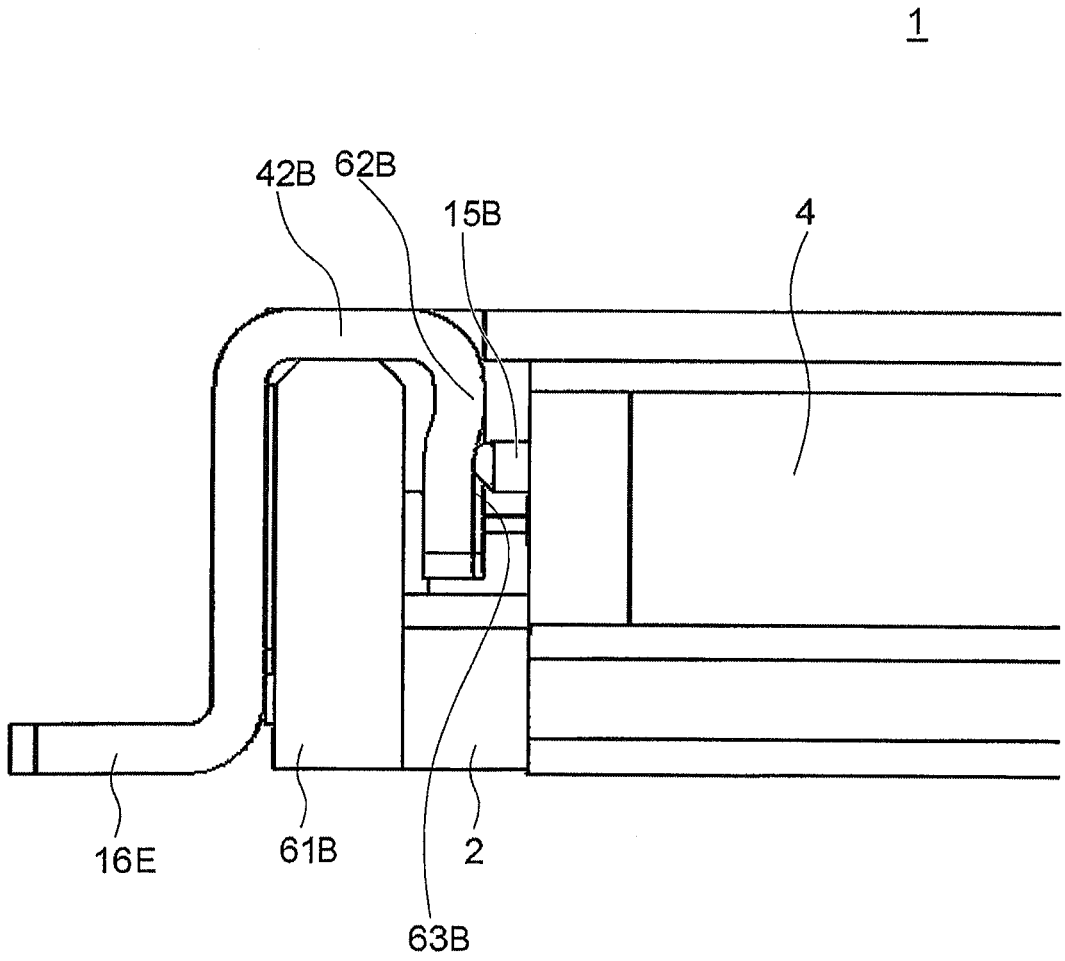
FIG. 21 is a rear view of the electrical connector 1 for explaining the cooperation of the contact between the actuator terminal 15 and the actuator-terminal contact portion 42 with the rotation of the actuator 4 and is a diagram showing a state where the actuator 4 is completely tilted to the rear.

In FIGS. 19 to 21, there are shown only a side wall 61B of the housing 2, which is located on the left side when the electrical connector 1 is seen from the rear, and only a convex portion 62B and a concave portion 63B corresponding to the side wall 61B. Actually, however, there are also present a side wall 61A of the housing 2, which is located on the right side when the electrical connector 1 is seen from the rear, and a convex portion 62A and a concave portion 63A corresponding to the side wall 61A. For the shape of this portion, see also FIG. 22.

When the actuator 4 is upright, the length between the convex portions 62A and 62B and the length between the concave portions 63A and 63B are each shorter than the length between the tips of the actuator terminals 15A and 15B. However, since the actuator-terminal contact portions 42 serve as the springs as described above, as the actuator 4 is tilted from the upright state, the tips of the actuator terminals 15 push away or outward the actuator-terminal contact portions 42 as shown in FIG. 20.

It is assumed that the length between the tips of the actuator terminals 15A and 15B is given as L, the length between the convex portions 62A and 62B is given as L1, and the length between the concave portions 63A and 63B is given as L2. Then, a relationship of L1<L2<L is established. Since L1<L2, while the actuator 4 is tilted, the springiness of each actuator-terminal contact portion 42, which was pushed away when the actuator terminal 15 rode over the convex portion 62, is partially restored when the actuator terminal 15 reaches the concave portion 63. By this restoration, it is possible to give a click feeling to a fingertip of a user tilting the actuator 4.

Since L1<L2, a force is required to some degree when raising the tilted actuator 4. As shown in FIG. 21, this allows each actuator-terminal contact portion 42 to operate as a simple locking mechanism and thus can prevent the actuator 4 from accidentally rising with a slight force.

Even when the actuator terminals 15 ride over the convex portions 62 to reach the concave portions 63, the distance between the concave portions 63A and 63B is in an increased state due to pushing by the actuator terminals 15 based on the relationship of L2<L. Therefore, as shown in FIG. 21, the contact between the tip of each actuator terminal 15 and the concave portion 63 is maintained.

Figure 22:
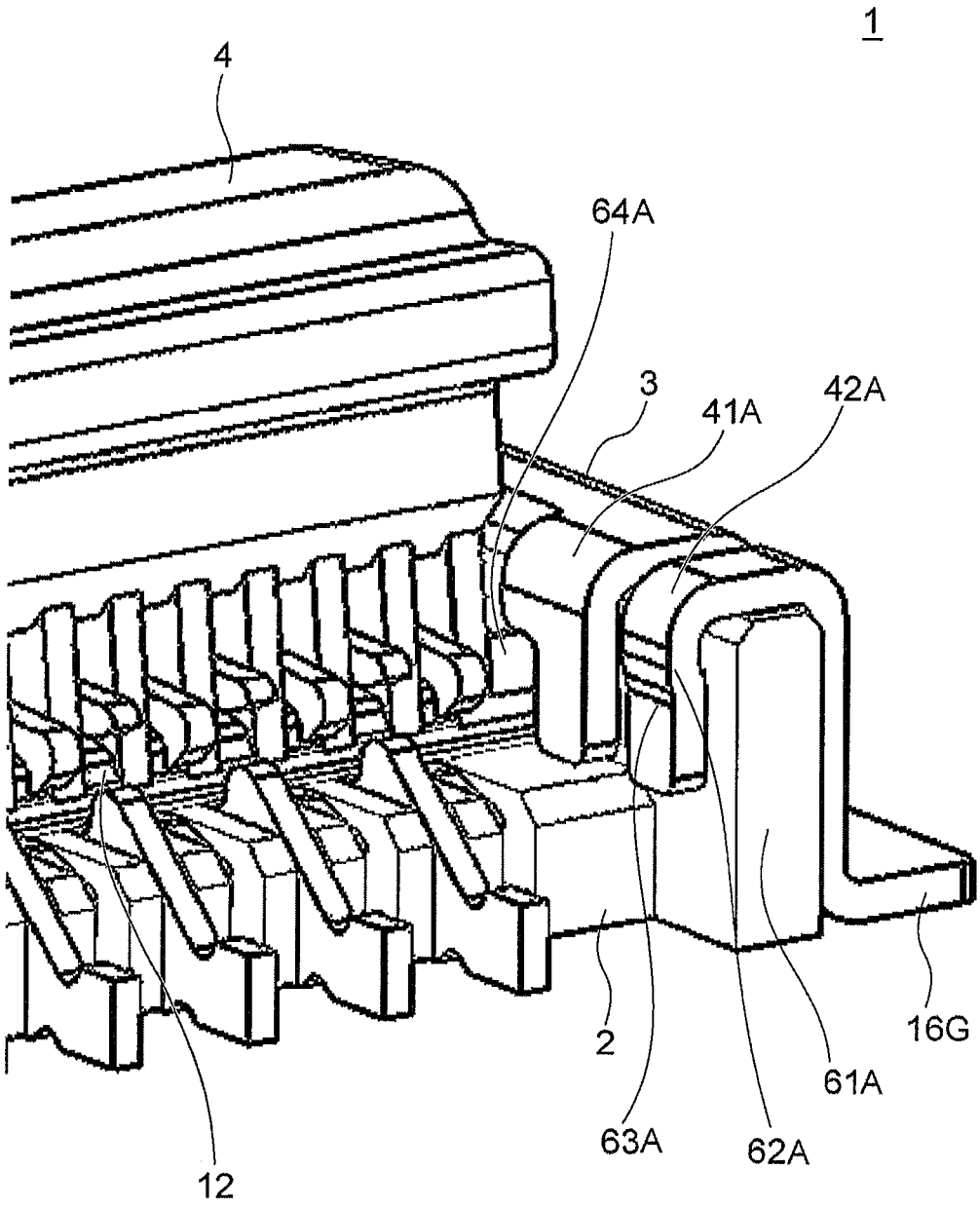
FIG. 22 is a rear perspective view of the electrical connector 1 for explaining a cover portion 41 supporting a cam rotary shaft 64 of the actuator 4.

Next, a description will be given about holding of cam rotary shafts 64A and 64B of the actuator 4. As described above with reference to FIGS. 3 and 4, the actuator 4 has the cams 12. The cam rotary shafts 64A and 64B having a cylindrical shape and being concentric with the cams 12 protrude at both ends of the actuator 4. The cam rotary shaft 64A, 64B is supported from below by a bearing recess provided on the side wall 61A, 61B of the housing 2. Further, as shown in FIG. 22 (one of the cover portions, i.e. the cover portion 41A, and one of the cam rotary shafts, i.e. the cam rotary shaft 64A, are shown), the cam rotary shaft 64A, 64B is supported from above by the cover portion 41A, 41B of the shield shell 3. By providing the cover portions 41A and 41B, it is possible to prevent the actuator 4 from easily coming off the housing 2.

Figure 23:
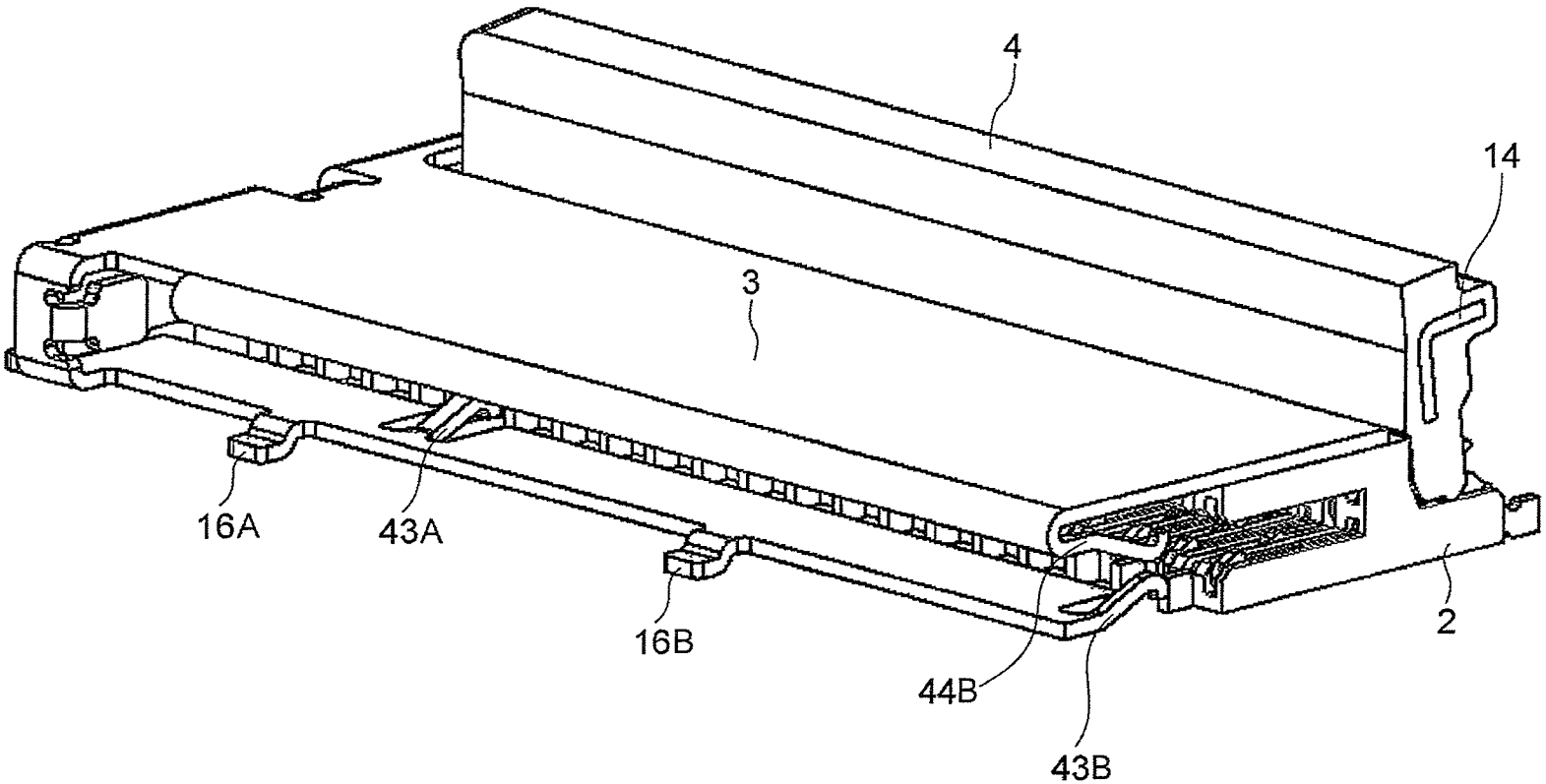
FIG. 23 is a cross-sectional perspective view of the electrical connector 1, taken along a plane including a first ground spring 43B and a second ground spring 44B, when the actuator 4 is in the upright state, wherein hatching for representing cross sections of components is omitted.
Figure 24:
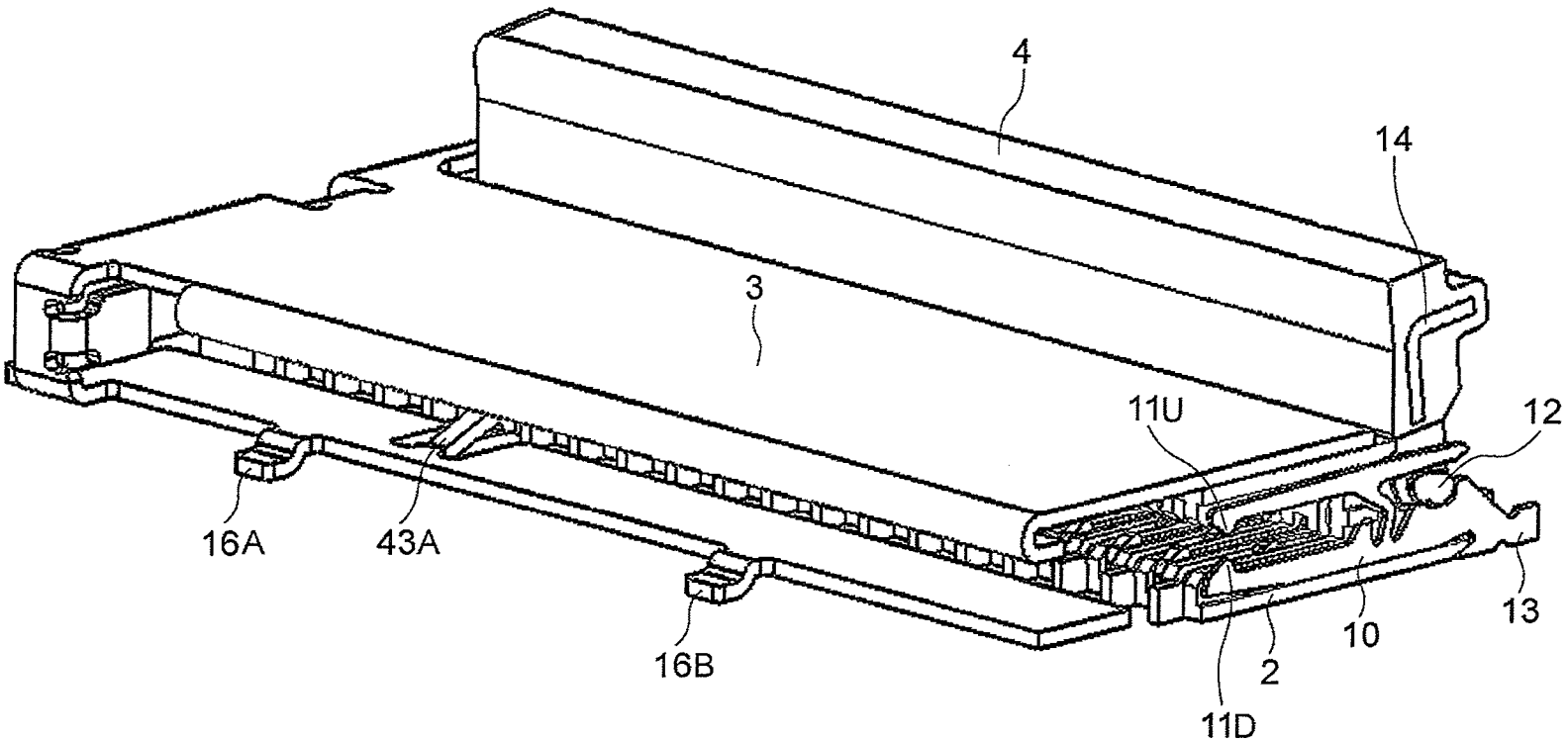
FIG. 24 is a cross-sectional perspective view of the electrical connector 1, taken along a plane including a first signal contact 10, when the actuator 4 is in the upright state, wherein hatching for representing cross sections of components is omitted.
Figure 25:
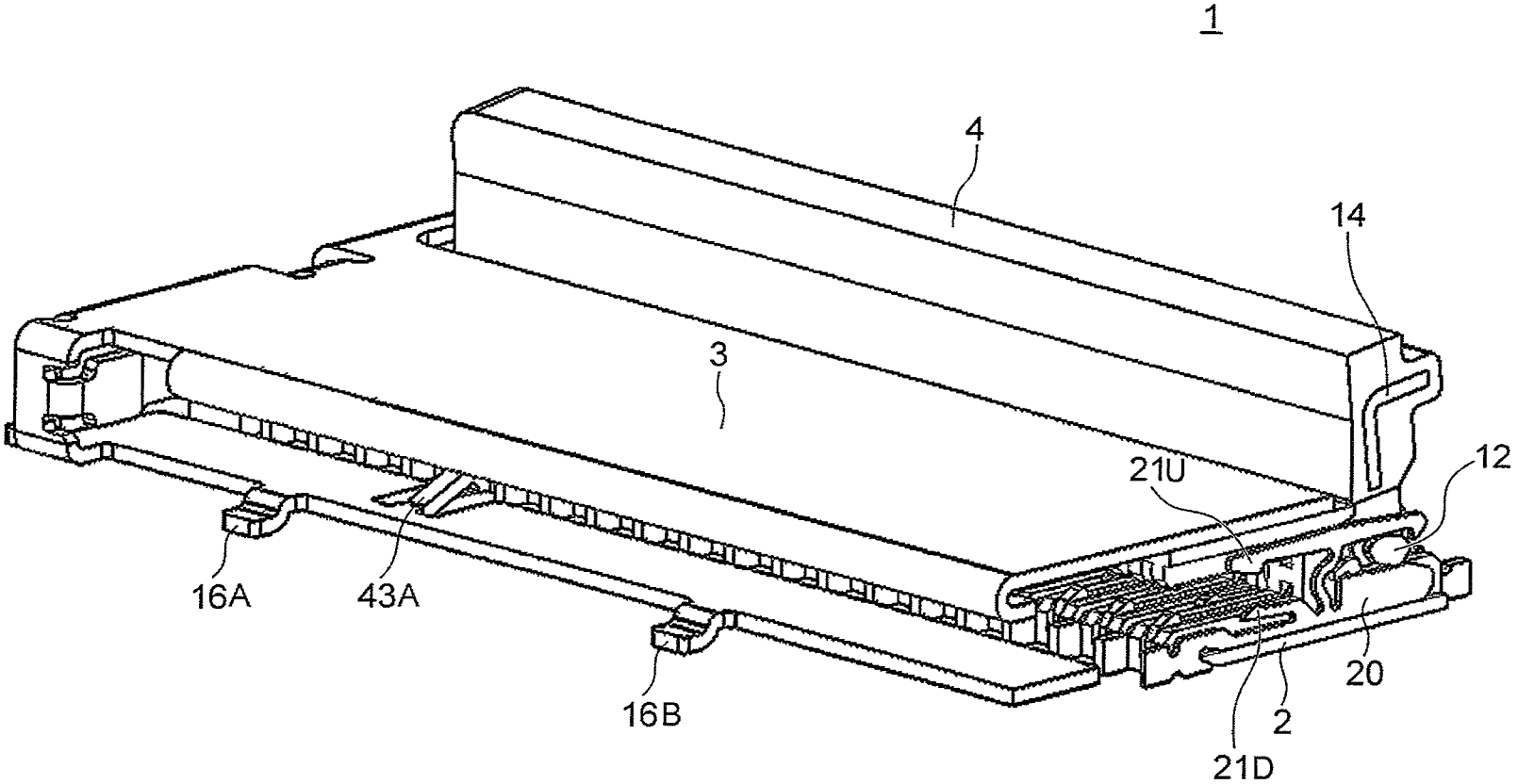
FIG. 25 is a cross-sectional perspective view of the electrical connector 1, taken along a plane including a second signal contact 20, when the actuator 4 is in the upright state, wherein hatching for representing cross sections of components is omitted.

Next, electrical paths which are established between the electrical connector 1 and the flat cable 30 will be described. FIGS. 23, 24, and 25 show three cross-sectional perspective views with different cross sections. In particular, the positional relationship and structures of the first ground spring 43B and the second ground spring 44B are easily seen from FIG. 23. By comparing these figures, it is seen that when the positions of the contact points for establishing the electrical paths between the electrical connector 1 and the flat cable 30 are classified by the distance in a direction from the opening 100 of the electrical connector 1 toward the rear, there are three kinds of the contact points.

The first and second ground springs 43B and 44B shown in FIG. 23 are located closest to the opening 100, the contact points 21U and 21D of each second signal contact 20 shown in FIG. 25 are located on the deepest side of the electrical connector 1, and the contact points 11U and 11D of each first signal contact 10 shown in FIG. 24 are located between them.

The ground layer 34, the first signal layer contact portions 37, and the second signal layer contact portions 38 of the flat cable 30 correspond to these three kinds of the contact points which are different in position in the depth direction of the electrical connector 1. When the flat cable 30 is inserted into the electrical connector 1 and then the actuator 4 is tilted to establish connection therebetween, one of the contact points 21U and 21D of each second signal contact 20 is brought into contact with a corresponding one of the second signal layer contact portions 38 on the deepest side of the insertion portion 110 in the electrical connector 1. At a position closer to the opening 100, one of the contact points 11U and 11D of each first signal contact 10 is brought into contact with a corresponding one of the first signal layer contact portions 37. At a position further closer to the opening 100, the first ground springs 43 or the second ground springs 44 are brought into contact with the exposed portion of the ground layer 34.

A description will be further given of the cable surface facing direction when inserting the flat cable 30 into the electrical connector 1 and the contact positions of the first ground springs 43/the second ground springs 44, the first signal contacts 10, and the second signal contacts 20 when the flat cable 30 is attached to the electrical connector 1.

First, a description will be given of a state where the flat cable 30 is attached to the electrical connector 1 with the ground layer 34 side facing upward and with the signal layer 32 side facing downward.

Figure 26:
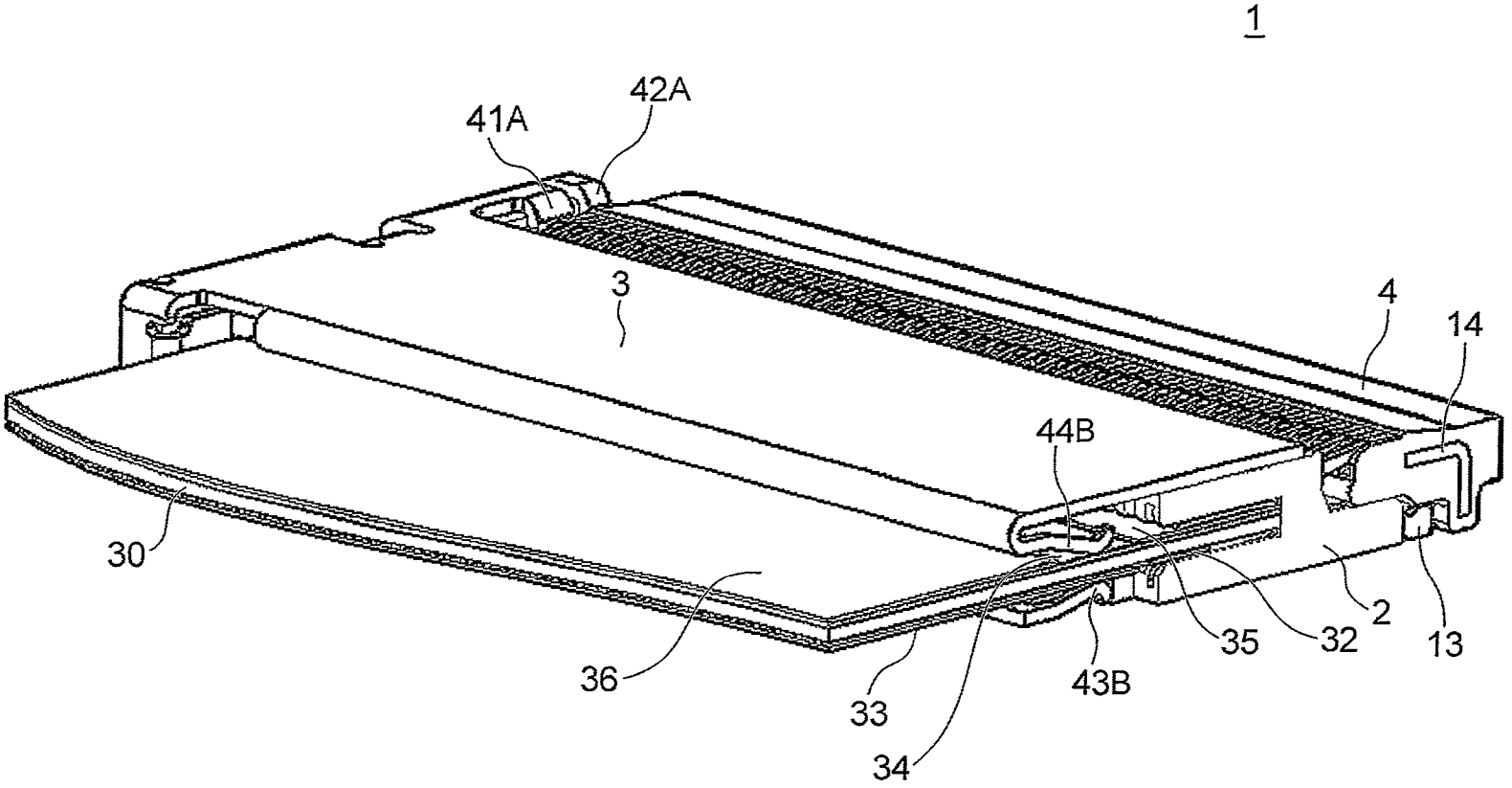
FIG. 26 is a cross-sectional perspective view of the electrical connector 1, taken along the plane including the first ground spring 43B and the second ground spring 44B, when the flat cable 30 with a ground layer 34 facing upward is attached to the electrical connector 1, wherein hatching for representing cross sections of components is omitted.

In this event, as shown in FIG. 26, the second ground springs 44 are brought into contact with the exposed portion of the ground layer 34 while the first ground springs 43 are brought into contact with the insulating layer 33. Therefore, the ground layer 34 of the flat cable 30 is brought into contact with the shield shell 3 at the second ground springs 44 and is further connected to the ground connecting portions (not illustrated) on the printed board through the ground terminals 16 of the shield shell 3, thereby establishing electrical paths. The exposed portion of the signal layer 32 is not in contact with any of the first and second ground springs 43 and 44. This is because, as described above with reference to FIG. 5, the distances from the forward end of the flat cable 30 to the position where the signal layer 32 is exposed and to the position where the ground layer 34 is exposed differ from each other.

Figure 27:
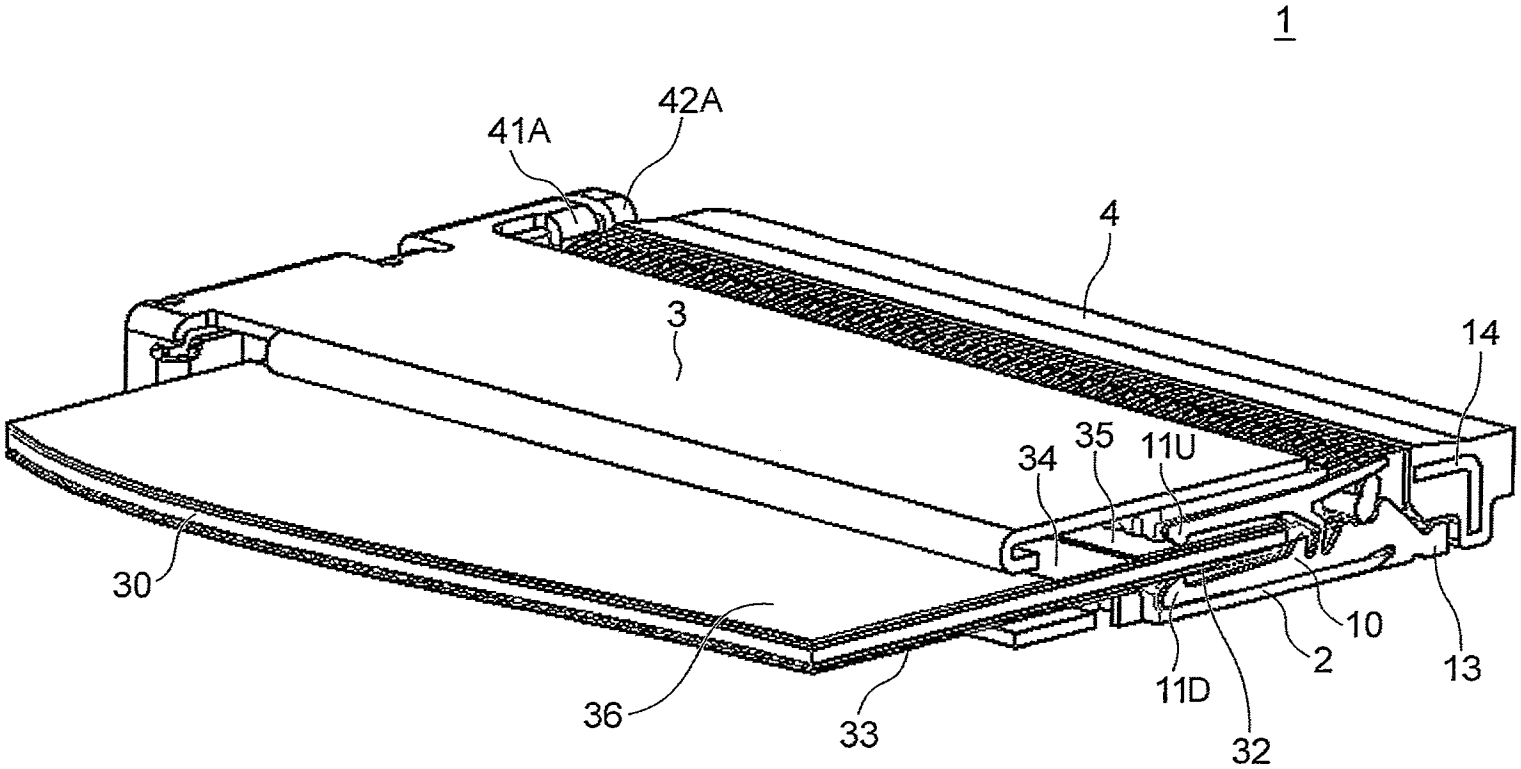
FIG. 27 is a cross-sectional perspective view of the electrical connector 1, taken along the plane including the first signal contact 10, when the flat cable 30 with the ground layer 34 facing upward is attached to the electrical connector 1, wherein hatching for representing cross sections of components is omitted.
Figure 28:
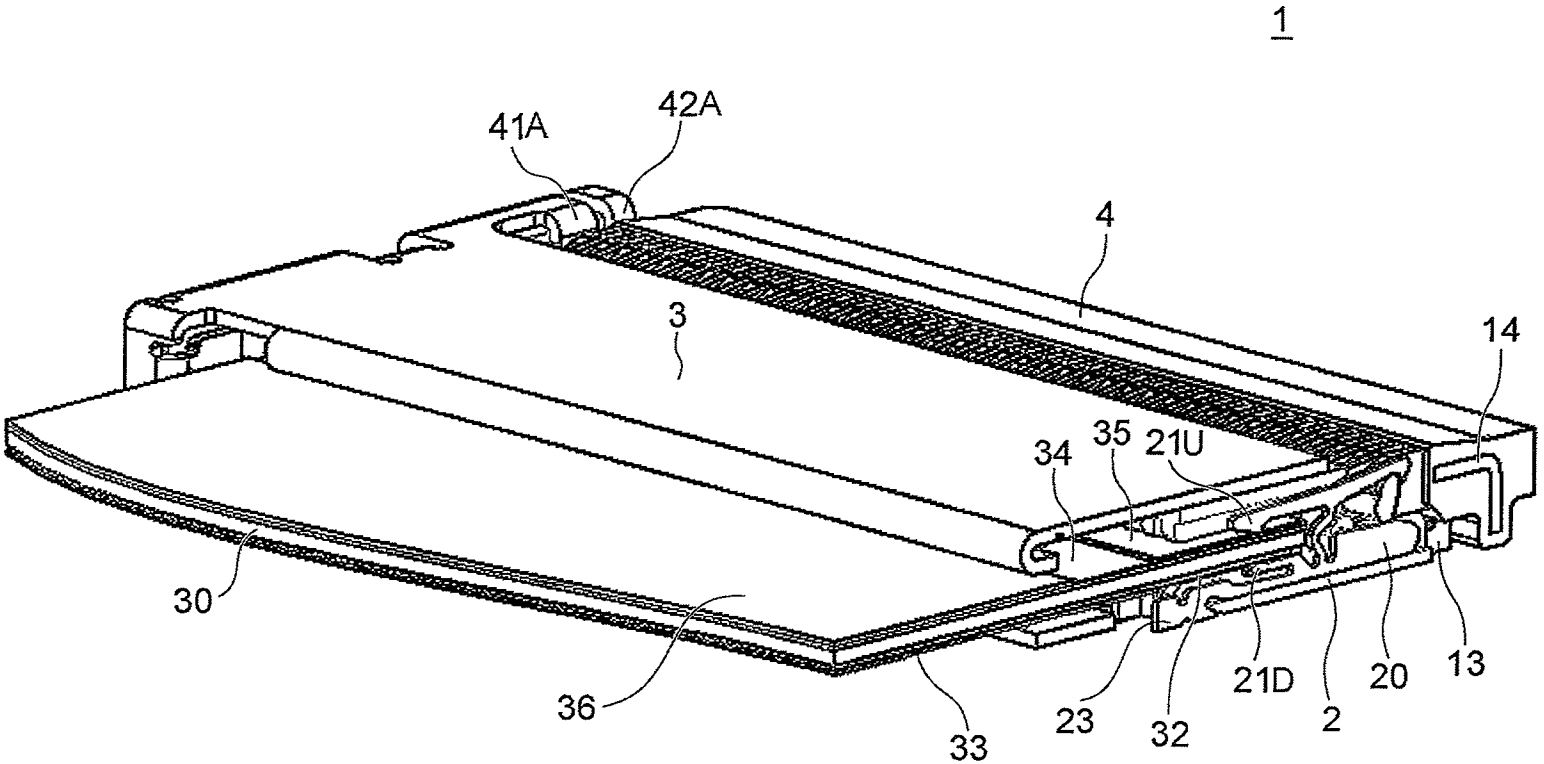
FIG. 28 is a cross-sectional perspective view of the electrical connector 1, taken along the plane including the second signal contact 20, when the flat cable 30 with the ground layer 34 facing upward is attached to the electrical connector 1, wherein hatching for representing cross sections of components is omitted.

With respect to the first signal contacts 10, as shown in FIG. 27, the contact points 11D are brought into contact with the exposed portion of the signal layer 32 while the contact points 11U are brought into contact with the insulating layer 35. Likewise, with respect to the second signal contacts 20, as shown in FIG. 28, the contact points 21D are brought into contact with the exposed portion of the signal layer 32 while the contact points 21U are brought into contact with the insulating layer 35.

Next, a description will be given of a state where the flat cable 30 is attached to the electrical connector 1 with the signal layer 32 side facing upward and with the ground layer 34 side facing downward, i.e. with a cable surface facing direction of the flat cable 30 reverse to that shown in FIGS. 29 to 31.

Figure 29:
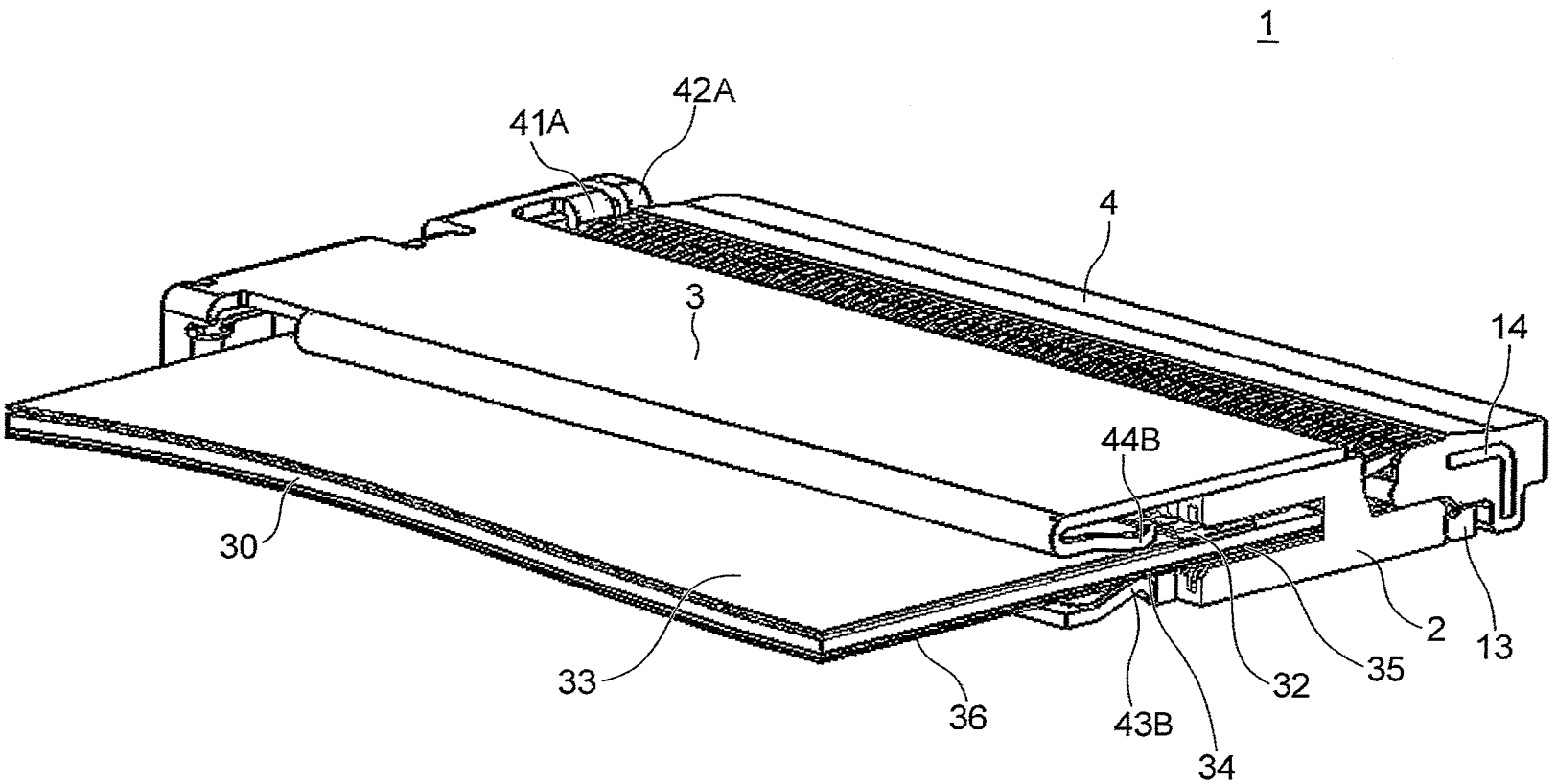
FIG. 29 is a cross-sectional perspective view of the electrical connector 1, taken along the plane including the first ground spring 43B and the second ground spring 44B, when the flat cable 30 with a signal layer 32 facing upward is attached to the electrical connector 1, wherein hatching for representing cross sections of components is omitted.

In this event, as shown in FIG. 29, the first ground springs 43B (43) are brought into contact with the exposed portion of the ground layer 34 while the second ground springs 44B (44) are brought into contact with the insulating layer 33. Therefore, the ground layer 34 of the flat cable 30 is brought into contact with the shield shell 3 at the first ground springs 43 and is further connected to the ground connecting portions (not illustrated) on the printed board through the ground terminals 16 of the shield shell 3, thereby establishing electrical paths. The exposed portion of the signal layer 32 is not in contact with any of the first and second ground springs 43 and 44. This is because, as described above with reference to FIG. 5, the distances from the forward end of the flat cable 30 to the position where the signal layer 32 is exposed and to the position where the ground layer 34 is exposed differ from each other.

Figure 30:
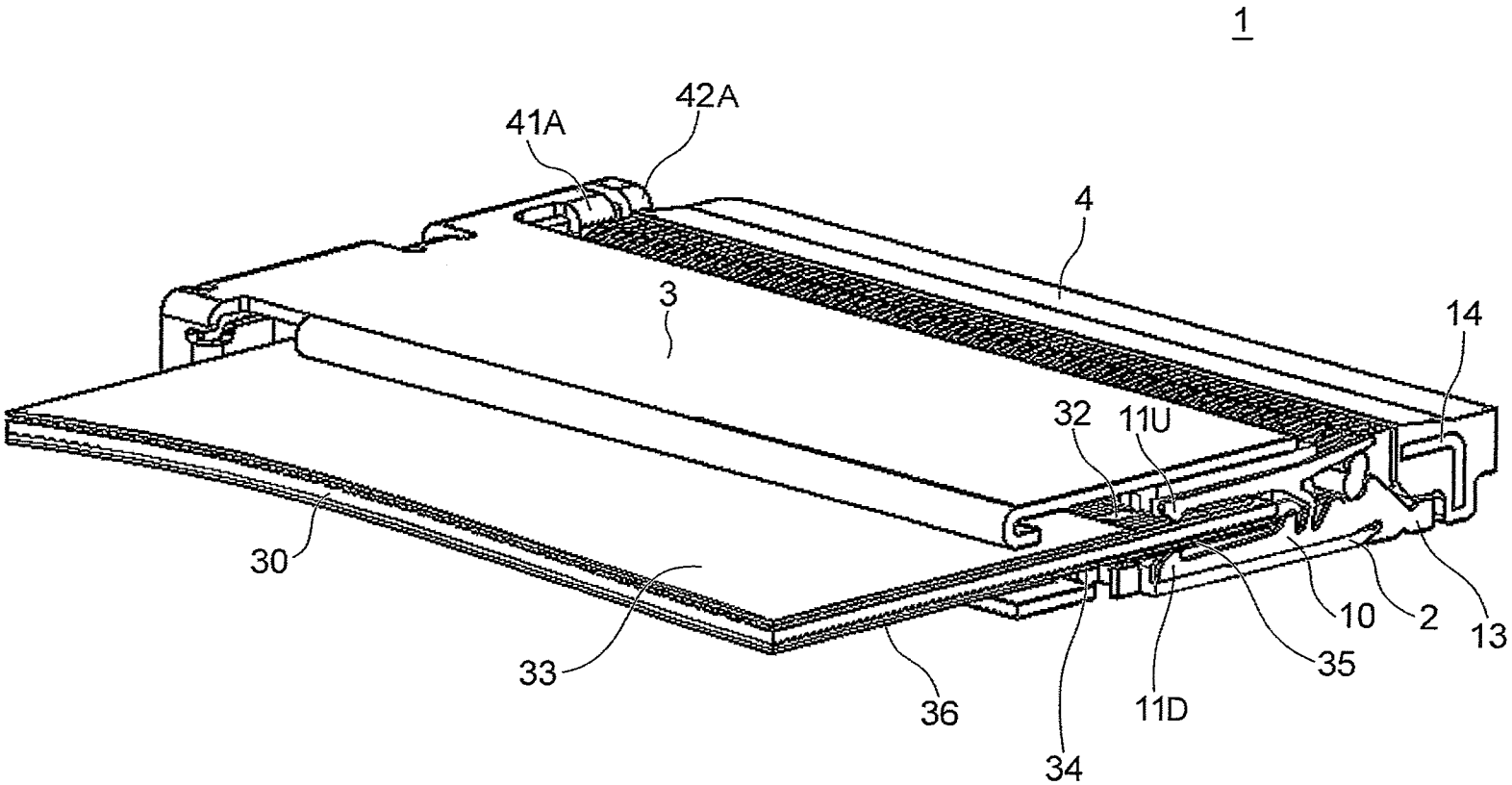
FIG. 30 is a cross-sectional perspective view of the electrical connector 1, taken along the plane including the first signal contact 10, when the flat cable 30 with the signal layer 32 facing upward is attached to the electrical connector 1, wherein hatching for representing cross sections of components is omitted.
Figure 31:
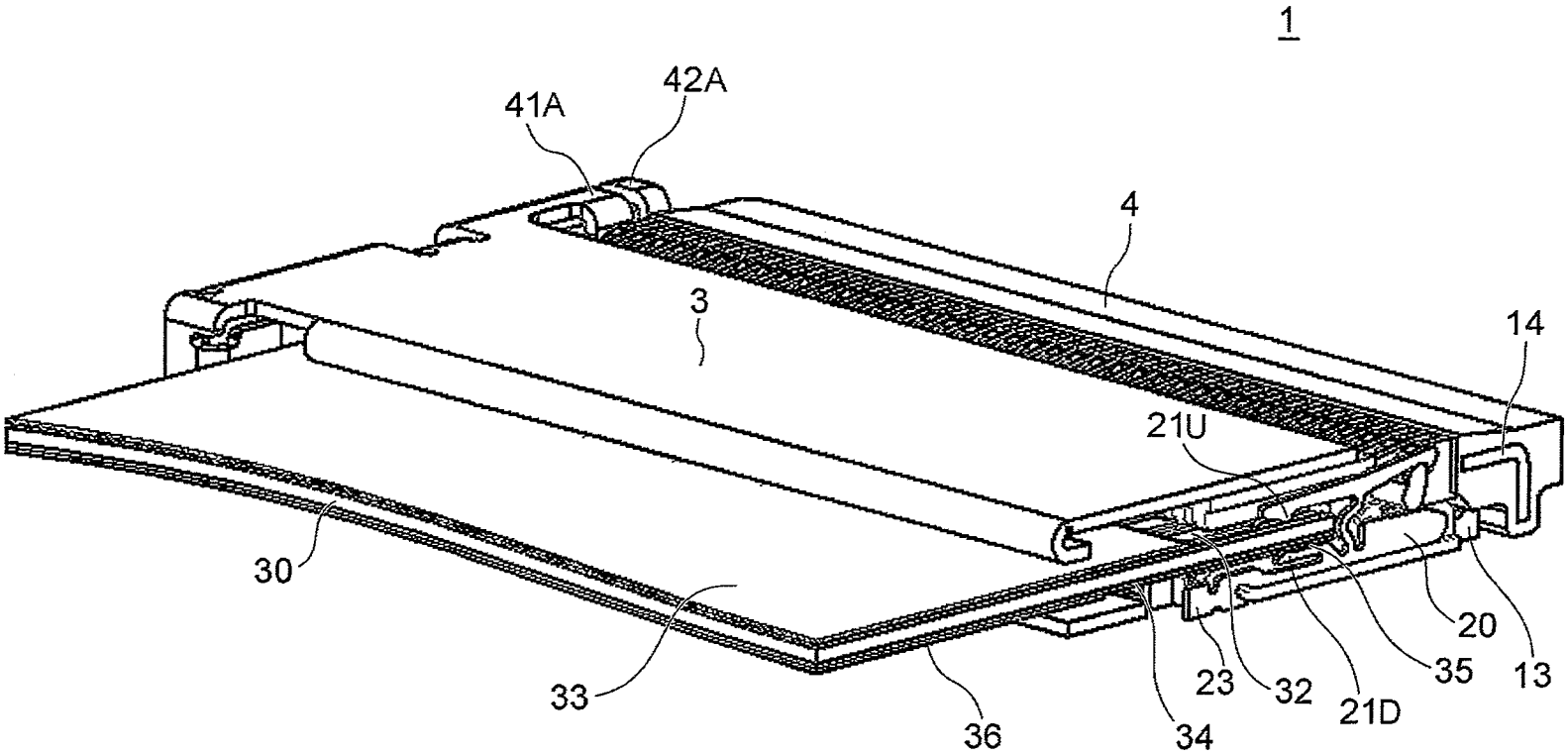
FIG. 31 is a cross-sectional perspective view of the electrical connector 1, taken along the plane including the second signal contact 20, when the flat cable 30 with the signal layer 32 facing upward is attached to the electrical connector 1, wherein hatching for representing cross sections of components is omitted.
Figure 32:
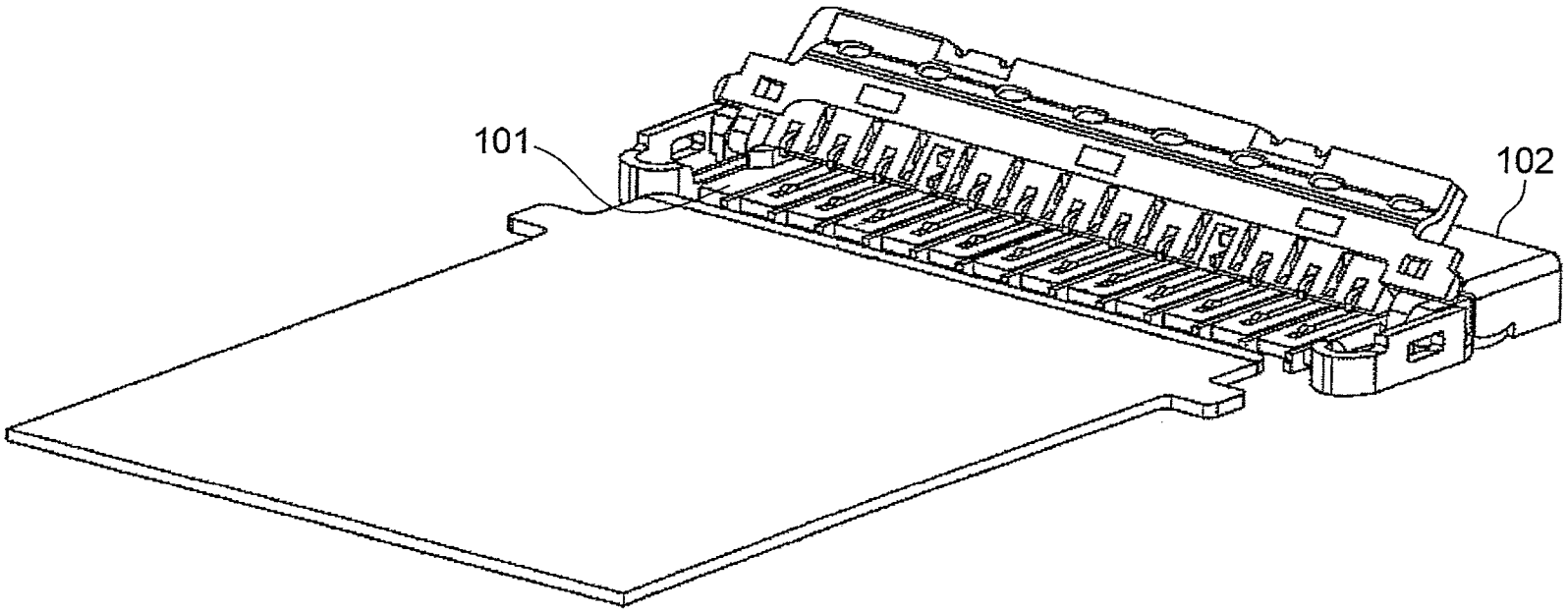
FIG. 32 is a diagram for explaining an electrical connector described in Patent Document 1.

With respect to the first signal contacts 10, as shown in FIG. 30, the contact points 11U are brought into contact with the exposed portion of the signal layer 32 while the contact points 11D are brought into contact with the insulating layer 35. Likewise, with respect to the second signal contacts 20, as shown in FIG. 31, the contact points 21U are brought into contact with the exposed portion of the signal layer 32 while the contact points 21D are brought into contact with the insulating layer 35.

As described above, even if the flat cable 30 is attached to the electrical connector 1 with either of the signal layer 32 and the ground layer 34 facing upward or downward, the signal layer 32 and the ground layer 34 are brought into contact with the signal contact points and the ground contact points of the electrical connector 1, respectively.

In the electrical connector 1, the contact points to the ground layer 34 are provided on the front side and the contact points to the signal layer 32 are provided on the rear side, i.e. the contact points to the ground line of the flat cable 30 and the contact points to the signal lines of the flat cable 30 are arranged at the different positions along the depth direction of the electrical connector 1 or along the insertion direction of the flat cable 30. Therefore, it is possible to reduce the width of the electrical connector 1 compared to a case where contact points to a ground line and contact points to signal lines are arranged in a row in a width direction of an electrical connector.

While this invention has been described with reference to the specific embodiment, this invention is not limited thereto. For example, it has been described that the flat cable 30 has the 25 first signal layer contact portions 37 and the 26 second signal layer contact portions 38, but these numbers of the contact portions are only by way of example.

What is claimed is:

1. An electrical connector for connection between a plate-like connection object and a board, wherein, assuming that a side where an opening for insertion of the connection object therethrough is provided is called a front and a side opposite to the opening is called a rear, the electrical connector comprises:

a signal contact having a contact point for contact with a contact portion of the connection object and a terminal portion for connection to a connecting portion of the board;

a housing holding the signal contact;

a shield shell at least partially covering the housing;

an insertion portion which is a space at least partially surrounded by a plane defined by the opening, the housing, and the shield shell; and an actuator having a structure in which an insulator at least partially covers a conductor member, the actuator adapted to operate to press the contact point of the signal contact against the contact portion of the connection object inserted into the insertion portion through the opening when the actuator is tilted to the rear, and wherein when the actuator is tilted to the rear so that the contact point of the signal contact and the contact portion of the connection object are brought into contact with each other, the conductor member covers a position, at the rear of the housing, where the connecting portion of the board and the terminal portion of the signal contact are connected to each other.

2. The electrical connector according to claim 1, wherein the electrical connector is surface-mounted on the board, and wherein when the actuator is tilted to the rear, the position where the connecting portion of the board and the terminal portion of the signal contact are connected to each other is located under the actuator.

3. The electrical connector according to claim 1, wherein the conductor member has an actuator terminal protruding from the insulator, and wherein the shield shell has an actuator-terminal contact portion which is in non-contact with the actuator terminal when the actuator is in an upright state, and which is in contact with the actuator terminal in a state where the actuator is tilted to the rear.

4. The electrical connector according to claim 1, wherein the conductor member is a beam-like member having a generally L-shape in cross section and extending in a width direction of the actuator.

5. The electrical connector according to claim 1, wherein the conductor member is a beam-like member having a generally circular-arc cross section and extending in a width direction of the actuator.

6. The electrical connector according to claim 1, wherein a cross section of the actuator has a convex portion protruding to the rear when the actuator is in an upright state, and wherein at least part of the convex portion covers the conductor member.

7. The electrical connector according to claim 1, wherein the shield shell at least partially covers a plane approximately parallel to a surface of the connection object inserted and a plane approximately perpendicular to the plane.

8. The electrical connector according to claim 7, wherein the shield shell has a ground terminal for connection to a ground connecting portion of the board.

9. The electrical connector according to claim 1, wherein the connection object has a structure in which a signal layer comprising the contact portion and a first insulating layer made of an insulator are stacked on one of surfaces of a base layer and a shield layer made of a conductor and a second insulating layer made of an insulator are stacked on the other surface of the base layer, wherein part of the shield layer is exposed from the second insulating layer, wherein a ground spring which generates a force in a direction to press a surface on the shield layer side of the connection object, inserted, for contact with the exposed part of the shield layer is provided in the insertion portion, and wherein when the connection object is inserted and the actuator is tilted to the rear, an electrically conductive path is formed through the shield layer, the ground spring, and the ground terminal.

10. The electrical connector according to claim 9, wherein, assuming that one of surfaces of the connection object is called a first surface and the other surface of the connection object is called a second surface, the electrical connector comprises a first ground spring which is the ground spring that generates a force in a direction to press the first surface of the connection object inserted, and a second ground spring which is the ground spring that generates a force in a direction to press the second surface of the connection object inserted, wherein when the connection object is inserted with the first surface being on the shield layer side and with the second surface being on the signal layer side, an electrically conductive path is formed through the shield layer, the first ground spring, and the ground terminal, and wherein when the connection object is inserted with the first surface being on the signal layer side and with the second surface being on the shield layer side, an electrically conductive path is formed through the shield layer, the second ground spring, and the ground terminal.

* * * * *